US009669411B2

(12) United States Patent
Matlin et al.

(10) Patent No.: US 9,669,411 B2
(45) Date of Patent: Jun. 6, 2017

(54) SHREDDER AUTO FEED SYSTEM

(71) Applicant: FELLOWES, INC., Itasca, IL (US)

(72) Inventors: Tai Hoon K. Matlin, Round Lake Beach, IL (US); Dipan Pravin Surati, Des Plaines, IL (US); Dennis William Gruber, Arlington Heights, IL (US)

(73) Assignee: FELLOWES, INC., Itasca, IL (US)

( * ) Notice: Subject to any disclaimer, the term of this patent is extended or adjusted under 35 U.S.C. 154(b) by 749 days.

(21) Appl. No.: 14/042,384

(22) Filed: Sep. 30, 2013

(65) Prior Publication Data

US 2015/0090818 A1 Apr. 2, 2015

(51) Int. Cl.
*B02C 18/22* (2006.01)
*B02C 18/00* (2006.01)
(Continued)

(52) U.S. Cl.
CPC ..... *B02C 18/2275* (2013.01); *B02C 18/0007* (2013.01); *B65H 1/04* (2013.01);
(Continued)

(58) Field of Classification Search
CPC ..... B02C 18/2275; B02C 18/0007; B02C 2018/168; B02C 2018/0023; B65H 1/04;
(Continued)

(56) References Cited

U.S. PATENT DOCUMENTS 4,192,467 A 3/1980 Hatanaka
4,231,530 A 11/1980 Hatanaka
(Continued)

FOREIGN PATENT DOCUMENTS

CN 1053778 A 8/1991
CN 1577132 A 2/2005
(Continued)

OTHER PUBLICATIONS

International Preliminary Report on Patentability for PCT International Patent Application No. PCT/US2008/066531, mailed Mar. 31, 2011.
(Continued)

*Primary Examiner* — Faye Francis
*Assistant Examiner* — Onekki Jolly
(74) *Attorney, Agent, or Firm* — Pillsbury Winthrop Shaw Pittman LLP

(57) ABSTRACT

A shredder has cutter elements for destroying articles (paper) and a feed mechanism for advancing paper from a stack in a tray into cutters for shredding. The feed mechanism has a feed member provided adjacent to the tray with an elastic arm for engaging and disengaging the stack. The feed member rotates in a feeding direction about an axle, with the elastic arm elastically deforming to apply pressure to feed paper atop the stack to the cutters. The elastic arm can include a protruding tip that is inserted into the stack. The tray includes a curved feed bed to assist in feeding paper into the cutters and deforming the elastic arm. A pivot arm can also move the feed member relative to the tray (e.g., vertically). A disengagement mechanism can hold the feed mechanism in an inoperable feeding position when a drawer or tray is moved into an open position.

26 Claims, 12 Drawing Sheets

(51) Int. Cl.
*B65H 1/04* (2006.01)
*B65H 3/22* (2006.01)
*B02C 18/16* (2006.01)

(52) U.S. Cl.
CPC ..... *B65H 3/22* (2013.01); *B02C 2018/0023* (2013.01); *B02C 2018/168* (2013.01); *B65H 2402/54* (2013.01); *B65H 2405/1114* (2013.01)

(58) Field of Classification Search
CPC ..... B65H 3/22; B65H 2402/54; B65H 2405/1114
USPC ..... 241/30, 37.5, 100, 222, 224, 225, 236
See application file for complete search history.

(56) References Cited

U.S. PATENT DOCUMENTS 4,232,860 A 11/1980 Brown
4,529,134 A 7/1985 Williams
4,565,330 A * 1/1986 Katoh ..... B02C 18/0007 241/236
4,815,669 A * 3/1989 Fujii ..... B02C 18/0007 241/236
4,815,670 A 3/1989 Iwai
4,817,877 A 4/1989 Itoh
4,817,887 A 4/1989 Harigaya et al.
4,821,967 A 4/1989 Moriyama
4,878,626 A 11/1989 Leuthold et al.
4,893,759 A * 1/1990 Mizobata ..... B02C 18/0007 241/100
4,957,243 A 9/1990 Kanagaki et al.
4,986,481 A 1/1991 Fujii et al.
5,009,410 A 4/1991 Fujii et al.
5,188,301 A 2/1993 Hasegawa
5,261,614 A 11/1993 Schwelling
5,318,229 A * 6/1994 Brown ..... B02C 18/0007 241/236
5,362,002 A 11/1994 Tsai
5,441,249 A 8/1995 Todaro
5,538,193 A 7/1996 Takahashi et al.
5,662,280 A 9/1997 Nishio et al.
5,743,473 A 4/1998 Gregg
5,772,129 A 6/1998 Nishio et al.
5,871,162 A 2/1999 Rajewski
5,884,855 A 3/1999 Chang
5,954,279 A 9/1999 Siegfried et al.
6,332,607 B1 12/2001 Van der Werff
6,390,397 B1 5/2002 Ko
6,502,812 B2 1/2003 Belec
7,040,559 B2 5/2006 Matlin et al.
7,490,789 B2 * 2/2009 Omi ..... B02C 18/0007 241/225
7,500,625 B2 3/2009 Castronovo
7,500,627 B2 3/2009 Park et al.
7,658,342 B2 * 2/2010 Chang ..... B02C 18/0007 241/225
7,757,985 B2 * 7/2010 Chen ..... B02C 18/0007 241/100
7,823,873 B1 11/2010 Su
7,828,235 B2 11/2010 Matlin et al.
7,963,472 B2 6/2011 Odman et al.
8,123,152 B2 2/2012 Matlin et al.
8,167,223 B2 5/2012 Jensen et al.
2001/0011793 A1 8/2001 Suzuki et al.
2002/0070300 A1 6/2002 McLean et al.
2002/0190146 A1 12/2002 Irwin
2004/0135305 A1 7/2004 Bagrosky
2005/0023745 A1 * 2/2005 Morimoto ..... B65H 3/0615 271/117
2005/0072870 A1 4/2005 Dziesinski et al.
2005/0230897 A1 10/2005 Canini
2005/0274836 A1 12/2005 Chang
2006/0054727 A1 3/2006 Ko
2006/0179987 A1 8/2006 Park et al.
2006/0249609 A1 11/2006 Huang
2007/0181722 A1 8/2007 Dahle
2007/0235573 A1 10/2007 Johnson
2008/0011888 A1 * 1/2008 Dziesinski ..... B02C 18/0007 241/58
2008/0179436 A1 7/2008 Kuraoka
2008/0197220 A1 8/2008 Tsai
2008/0210794 A1 9/2008 Schwelling et al.
2009/0008871 A1 1/2009 Omi
2010/0032505 A1 2/2010 Jensen
2010/0032507 A1 * 2/2010 Chen ..... B02C 18/0007 241/34
2010/0176227 A1 * 7/2010 Davis ..... B02C 18/0007 241/34
2011/0056952 A1 3/2011 Borowski et al.
2011/0165035 A1 7/2011 Lewis et al.
2011/0204168 A1 8/2011 Su
2011/0297766 A1 * 12/2011 Chen ..... B02C 18/0007 241/33
2011/0297770 A1 * 12/2011 Matlin ..... B02C 18/0007 241/36
2013/0134244 A1 5/2013 Gao et al.
2014/0103151 A1 4/2014 Xu

FOREIGN PATENT DOCUMENTS

CN 201231172 Y 5/2009
CN 201470445 U1 5/2010
CN 201735438 U1 2/2011
DE 3215380 C2 10/1983
DE 3219693 A1 12/1983
DE 9400310 U1 5/1994
DE 3814424 A1 11/1999
EP 281136 B1 9/1988
WO WO2008095693 A1 8/2008
WO WO2009017885 A1 2/2009
WO WO2009035178 A1 3/2009

OTHER PUBLICATIONS

International Search Report and Written Opinion for PCT International Application No. PCT/US2008/066531, mailed Oct. 22, 2008.
Rexel SHRD UK/EU REXEL AUTO+ C/C shredder product description and datasheet from Rexel website, obtained from <url: http://www.rexeleurope.com/rexel/en/gb/p/217/2101998/shrd+uk-eu+rexel+auto%2b+c-c.aspx>, Aug. 21, 2009, (2 pages).
German Office Action for German Application No. 112008001840.5, dated Aug. 7, 2012, 7 pages.
Great Britain Examination Report for Great Britain Application No. GB1000398.6, dated Jul. 27, 2011, 5 pages.
Great Britain Examination Report for Great Britain Application No. GB1115499.4, dated Jan. 9, 2012, 4 pages.
Chinese Office Action for Chinese Application No. 201110278800.6, dated May 22, 2013, 10 pages.
International Preliminary Report on Patentability for PCT International Patent Application No. PCT/US2014/014667, mailed Sep. 24, 2015.
International Search Report and Written Opinion issued Dec. 4, 2013 in PCT/US2013/062266.
Office Action issued on Mar. 4, 2015 in U.S. Appl. No. 13/652,363.
International Search Report and Written Opinion issued on Jul. 16, 2014 in International Application No. PCT/2014US/014667.
International Preliminary Report on Patentability issued Apr. 21, 2015 in International Application PCT/US2013/062266.

* cited by examiner

SHREDDER AUTO FEED SYSTEM

BACKGROUND

Field

The present invention is generally related to an apparatus having cutter elements for destroying documents such as paper sheets. In particular, the apparatus comprises a mechanism for advancing sheets from a stack of paper in a tray into the cutter elements for shredding.

Background

A common type of shredder has a shredder mechanism contained within a housing that is mounted atop a container. The shredder mechanism typically includes a series of cutter elements that shred articles such as paper that are fed therein and discharge the shredded articles downwardly into the container. An example of such a shredder may be found, for example, in U.S. Pat. No. 7,040,559.

Prior art shredders have a predetermined amount of capacity or amount of paper that can be shredded in one pass between the cutter elements. Typically, the sheets of paper are fed into the shredder mechanism manually. Thus, when an operator needs to shred, he or she can only shred a number of sheets of paper by manually inserting one or more sheets one pass at a time. Examples of such shredders are shown in U.S. Pat. Nos. 4,192,467, 4,231,530, 4,232,860, 4,821,967, 4,986,481, 5,009,410, 5,188,301, 5,261,614, 5,362,002, 5,662,280, 5,772,129, 5,884,855, and 6,390,397 B1 and U.S. Patent Application Publications 2005/0274836 A1, 2006/0179987 A1, 2006/0179987 A1, 2006/0249609 A1, and 2006/0249609 A1, which are hereby incorporated by reference in their entirety.

Other shredders are designed for automatic feeding. The shredder will include a bin in which a state of documents can be placed. A feeding mechanism can then feed the documents from the stack into the shredding mechanism. This type of shredder is desirable in an office setting for productivity reasons, as the user can leave the stack in the bin and leave the shredder to do its work. U.S. Pat. Nos. 7,828,235 B2, 8,123,152 B2, and 8,167,223 B2, assigned to the same assignee of this disclosure and each of which are hereby incorporated by reference in their entirety, show examples of different types of "auto feed" shredders. With manual feed shredders, the user would have to spend time feeding smaller portions of the stack manually, thus taking away from productivity time.

SUMMARY

One aspect of this disclosure provides a shredder. The shredder includes: a housing; a paper shredder mechanism received in the housing and including a motor and cutter elements, the motor rotating the cutter elements in an interleaving relationship for shredding paper sheets fed therein; a tray for holding a stack of paper sheets to be fed into the cutter elements; a movable feed mechanism positioned above the tray, the movable feed mechanism having at least one feed member with at least one elastic arm, the at least one feed member adjacent to the tray for engaging and disengaging the stack with the at least one elastic arm; and a feed driver system constructed to drive the at least one feed member to rotate in a feeding direction with the at least one elastic arm thereof elastically deforming to apply pressure and frictionally feed paper sheets atop the stack to the cutter elements.

In another aspect of the disclosure, a method is provided for advancing articles into cutter elements for shredding. The method includes: providing a tray for holding a stack of articles for feeding into the cutter elements; providing a movable feed mechanism above the tray to advance articles into the cutter elements, the movable feed mechanism having at least one feed member with at least one elastic arm, the at least one feed member adjacent to the tray for engaging and disengaging the stack with the at least one elastic arm; rotating cutter elements in an interleaving relationship for shredding articles fed therein; and driving the movable feed mechanism in a feeding direction to feed articles to the cutter elements from atop the stack of paper sheets in the tray into the rotating cutter elements. The driving of the movable feed mechanism includes rotating the at least one feed member in a feeding direction with the elastic arm thereof elastically deforming to apply pressure and frictionally feed paper sheets atop the stack to the rotating cutter elements.

Another aspect of this disclosure provides a shredder. The shredder includes: a housing; a paper shredder mechanism received in the housing and including a motor and cutter elements, the motor rotating the cutter elements in an interleaving relationship for shredding paper sheets fed therein; a tray for holding a stack of paper sheets to be fed into the cutter elements; a drawer configured for sliding movement between an open position away from the shredder mechanism and a closed position adjacent to the shredder mechanism; a paper feed mechanism positioned above the tray, the paper feed mechanism having at least one feed member adjacent to the tray for engaging and disengaging the stack; a feed driver system constructed to drive the at least one feed member to rotate in a feeding direction to feed paper atop the stack to the cutter elements; and a disengagement mechanism provided adjacent to the paper feed mechanism for holding the paper feed mechanism in an inoperable feeding position when the drawer is in the open position.

Yet another aspect of this disclosure provides a method for operating a shredder for shredding. The method includes: providing a shredder mechanism with cutter elements positioned on parallel shafts; providing a tray for holding a stack of articles for feeding into the cutter elements; providing a drawer configured for sliding movement between an open position away from the shredder mechanism and a closed position adjacent to the shredder mechanism; providing a paper feed mechanism above the tray to advance articles into the cutter elements, the paper feed mechanism having at least one feed member adjacent to the tray for engaging and disengaging the stack; providing a disengagement mechanism adjacent to the paper feed mechanism for holding the paper feed mechanism in an inoperable feeding position when the drawer is in the open position; rotating cutter elements in an interleaving relationship on the parallel shafts for shredding articles fed therein; driving the paper feed mechanism to rotate in a feeding direction to feed articles to the cutter elements from atop the stack of articles in the tray into the rotating cutter elements; moving the drawer into its open position away from the shredder mechanism; and holding the paper feed mechanism in an inoperable feeding position using the disengagement mechanism.

Other features and advantages of the disclosure will become apparent from the following detailed description, the accompanying drawings, and the appended claims.

DETAILED DESCRIPTION OF THE PREFERRED EMBODIMENT(S)

Figure 1:
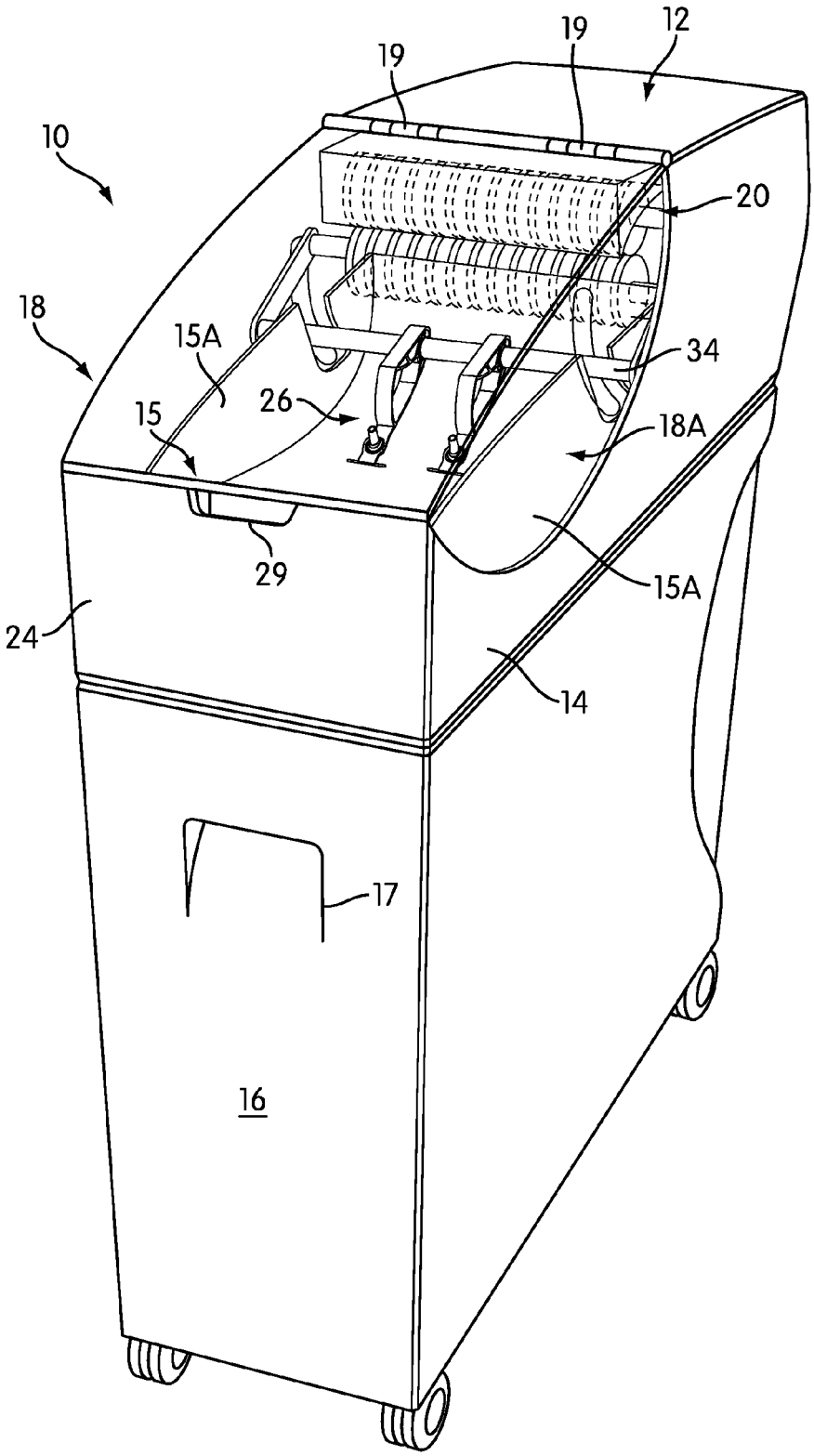
FIG. 1 illustrates a perspective view of a shredder in accordance with an embodiment of the present invention.

FIG. 1 is a perspective view of a shredder in accordance with an embodiment herein. The shredder 10 is designed to destroy or shred articles such as paper. The shredder 10 comprises a housing 12 that sits on top of a container 16, for example. The container 16 receives paper that is shredded by the shredder 10. The container 16 may comprise a hole, an opening, or a handle 17 (e.g., molded) for a user to grasp. For example, the user may grab handle 17 to open or access the inside of the container 16. The container 16 may be used to house a separate and removable waste bin, bag, or collection device, for example, or be a collection device or waste bin itself.

Generally speaking, the shredder 10 may have any suitable construction or configuration and the illustrated embodiment is not intended to be limiting in any way.

The shredder 10 comprises a paper shredder mechanism 20 in the housing 12, and includes a drive system with at least one motor 23, such as an electrically powered motor, and a plurality of cutter elements 21. The cutter elements 21 are mounted on a pair of parallel mounting shafts (shown in FIG. 2, for example) and are provided on such shafts in an interleaving fashion, and are sometimes referred to as a cutting block. A controller is provided in the shredder 10 to send electrical signals to the drive of the motor so that it rotates the cutting elements 21 of the shredder mechanism 20 in a shredding direction, thus enabling paper sheets to be fed therein, a reverse direction, to push sheets away from feeding (or out from the cutter elements 21 to prevent or stop further feeding), or to hold the shredder mechanism 20 in an idle position. The motor 23 operates using electrical power to rotatably drive first and second rotatable shafts of the shredder mechanism 20 and their corresponding interleaving cutter elements 21 through a conventional transmission (not shown) so that the cutter elements 21 shred or destroy articles fed therein (or reverse drive to remove fed articles or paper). The shredder mechanism may also include a subframe for mounting the shafts, motor, and transmission. The drive system may have any number of motors and may include one or more transmissions. Also, the plurality of cutter elements 21 are mounted on the first and second rotatable shafts in any suitable manner and are rotated in an interleaving relationship for shredding paper sheets fed therein (e.g., therebetween via an entrance or throat). The operation and construction of such a shredder mechanism 20 is well known and need not be discussed herein in detail.

The housing 12 of shredder 10 is designed to sit atop a container 16, as noted above. The housing 12 works in cooperation with a cartridge or tray 14. The tray 14 has a feed bed 15 and is designed to hold a stack 22 of articles (e.g., see FIG. 2) such as paper sheets therein that are to be shredded. The feed bed 15 can include upstanding sides 15A on either side thereof to contain articles therein and aid in directing or guiding moving of articles as they are fed into the shredder mechanism 20. The paper sheets in the tray 14 or bed 15 may be of any type, size, or construction (e.g., white paper, letter size, legal size, A4, envelopes, etc.). The articles can include items such as, but not limited to, paper, business cards, discs (CDs or DVDs), etc. Accordingly, for purposes of this disclosure, articles, paper, and paper sheets may be used interchangeably throughout with reference to items in the stack, without any intention of limiting such types of items therein.

In an embodiment, the shredder 10 includes a drawer 24. The tray 14 is provided within the drawer 24. The drawer 24 may comprise a hole, an opening, or a handle 29, shown in FIG. 1, for a user to grasp. For example, the user may grab handle 29 to slide or move the drawer 24 between an open position away from the shredder mechanism and a closed position adjacent to the shredder mechanism. The tray 14 can be configured for movement with the drawer 24.

The tray 14 is mounted such that paper may be fed from bed 15 of the tray 14 and into the cutter elements 21 of the shredder mechanism 20 (e.g., when the drawer 24 is closed). For example, the tray 14 and shredder mechanism 20 may be mounted horizontally such that the paper is fed into or between the interleaving cutter elements 21 of the shredder mechanism 20 at one end thereof and be destroyed. In an embodiment, the tray 14 has a length extending in a longitudinal direction relative to a longitudinal direction of the housing 12 of the shredder 10, or the shredder 10 itself. In an embodiment, the drawer 24 is mounted in a longitudinal direction relative to the shredder 10 and for movement in a horizontal manner relative to the shredder mechanism 20 (towards and away from it). The shafts of the cutter elements 21 can be positioned laterally or perpendicularly relative to the longitudinal direction of the tray 14, drawer 24, and/or of the shredder housing 12.

Figure 2:
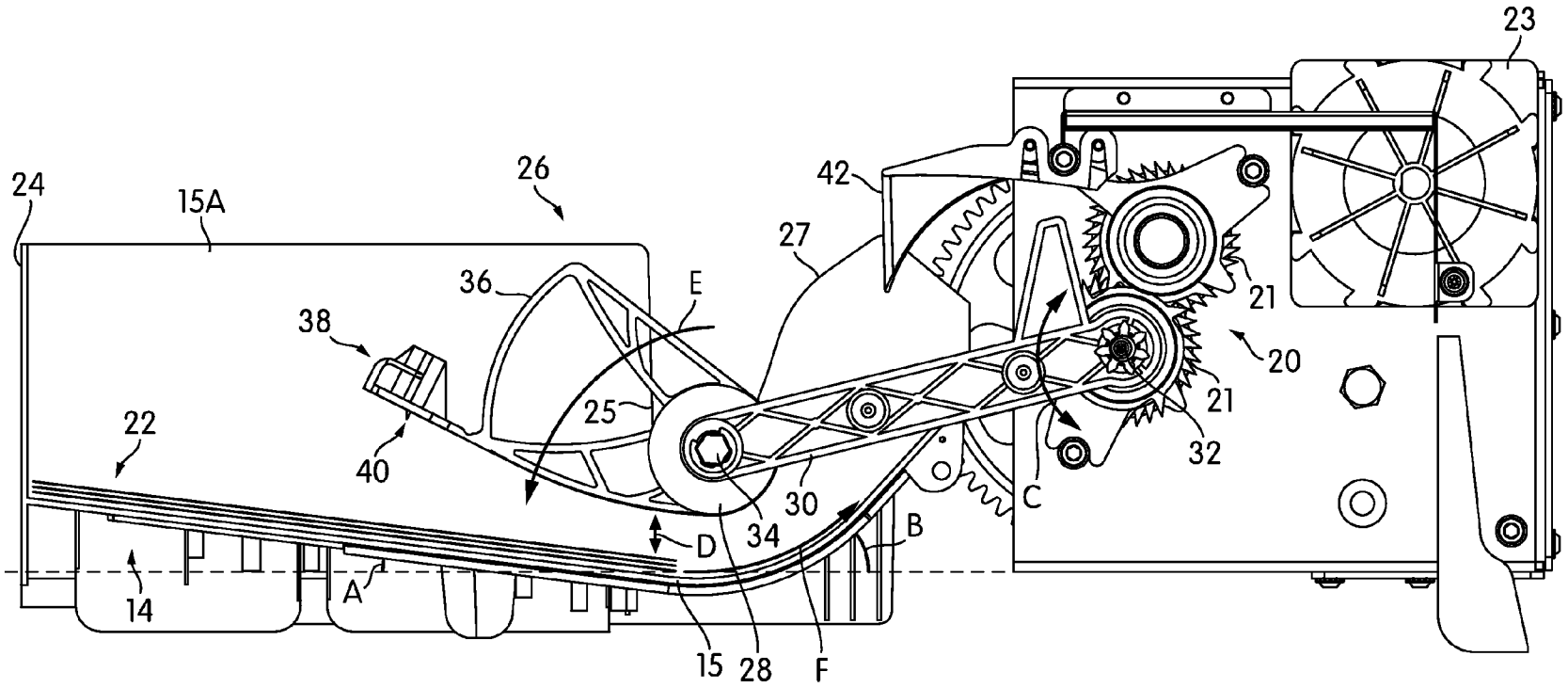
FIG. 2 illustrates side view of a movable feed mechanism for use in the shredder of FIG. 1 in accordance with an embodiment of the present invention.

In an embodiment, the tray 14 comprises a sloped or curved feed bed 15 (see, e.g., FIG. 2). The curved feed bed 15 assists in feeding sheet(s) atop a stack 22 in a forward and upward direction towards and/or into the cutters 21 of the shredder mechanism 20, for example. A curved feed bed 15 also assists in preventing jamming of the paper in the shredder mechanism 20. The feed bed 15 can be curved in the longitudinal direction, e.g., from back (near handle 29 of drawer 24) to front (e.g., adjacent the entrance or throat into and between the interleaving cutter elements 21). As shown in FIG. 2, the bed 15 itself includes a back end positioned distally from the shredder mechanism 20 (near handle 29 or front of drawer 24) that is positioned at an angle A relative to a horizontal plane of the drawer 24, for example. This angle A of the curved feed bed 15 creates a natural restrictor to paper feeding into the shredder mechanism 20. The angle A can aid in pushing articles in the stack 22 towards a front or proximal end of the bed 15 adjacent the shredder mechanism 20 (and a feed mechanism 36). Thus, despite the positioning of the sheets or articles in the tray 14, gravity resulting from the angle A can allow the sheets or articles to drop or lower towards the front end of the bed 15. The angle A can be varied relative to the horizontal plane and is not intended to be limiting. The front or proximal end of the bed 15 curves forwardly and upwardly towards the shredder mechanism 20 at an angle B relative to a horizontal plane of the drawer. In an embodiment, the angle B is at or approximately forty five (45) degrees (relative to the horizontal plane). In an embodiment, the angle B can be variable based on the desired amount of sheets for feeding into the cutting block or shredder mechanism 20. For example, a steeper or higher angle (relative to the horizontal plane) can reduce the ease of feeding thicker stack(s) of sheet(s) upwards along the curved feed bed 15 and into the shredder mechanism 20. The ease of gripping and flow of the gripped sheets towards the cutter elements 21 can be altered based on the angle (e.g., increase the angle to restrict ease of feeding the sheets). In an embodiment, the angle B can be determined based on the location of the shredder mechanism 20. For example, the proximal end of the feed bed 15 can be designed to direct and point into the nip of the cutters 21. Changing the angle A and/or the length of the surface of the curved feed bed 15 can also alter or restrict the ease of the flow of sheet(s) into the shredder mechanism 20.

Accordingly, the curvature of the feed bed 15 assists in positioning paper for feeding. Moreover, as further explained below, the curvature of the feed bed 15 also assist in feeding paper into the shredder mechanism when at least one feed member 36 is rotated in a feeding direction.

In an embodiment, the drawer 24 or tray 14 is provided with a lid 18, as shown in FIG. 1. The lid 18 can include a top and (right and left) side portions 18A that extend and align with (right and left) sides 15A of the tray 14 or drawer 24. The lid 18 is provided with hinges 19 such that the lid 18 may be pivoted between an open and closed position relative to the tray 14. Pivoting the lid 18 allows a user access to the inside of tray 14 or bed 15, such as for filling the tray 14 with paper to be shredded. In an embodiment, the tray 14 comprises a handle to assist in lifting the lid 18 (e.g., in the form of a lip provided near or on an edge of the lid). In an embodiment, the handle may extend from the side of the lid 18 on top of tray 14. However, any type or form of handle for assisting in lifting the lid 18 may be used and should not be limiting. Further, in accordance with an embodiment, the lid 18 need not be hinged or movable relative to the drawer. That is, the lid 18 can be provided as window for viewing the tray 14 or bed 15 and be provided as a stationary structure that drawer 24 is moved relative to.

In an embodiment, the drawer 24 and/or lid 18 may comprise a safety switch. The safety switch may be used to detect if the drawer or lid is provided in an open position. The safety switch may be coupled to the shredder mechanism 20 to prevent operation of the cutter elements 21 when the drawer 24 and/or lid 18 is in the open position. Similarly, when the drawer 24 and/or lid 18 is in a closed position, the shredder mechanism 20 may be activated to begin operation of, or ready to operate upon queue, the cutter elements 21 and an advancement or feed mechanism, as will be described.

The tray 14, lid 18, or drawer 24 may also comprise a locking mechanism that prevents a user from opening or accessing the tray, which may not be desirable while the shredder is in use. For example, the lid 18 or drawer 24 may include a magnetic latch. Alternatively, the tray or lid or drawer may include a code lock that prevents a user from opening the devices or having access to the tray. For example, a user may need to input a code into a control panel for access to the documents to be shredded in the tray 14.

In an embodiment, the lid 18 and/or drawer 24 may comprise an opening (not shown) for allowing insertion of paper sheets into the tray 14. That is, for example, when the lid 18 and/or drawer 24 are in the closed position, an opening or gap may be formed between the lid and bottom of the tray 14 or feed bed 15. Thus, the tray 14 may also be filled by inserting paper sheets (e.g., a single sheet or a small stack) through the gap and into the feed bed 15 without having to lift the lid 18 or pull open the drawer 24. This feature may be advantageous, for example, where the shredder is running and feeding from a large stack and the user simply wants to add a small number of documents to the tray 14 or bed 15. Rather than opening the lid 18 and stopping the shredding process with the safety switch, the user can just slip the small number of documents into the stack 22 via the gap.

However, the use of a lid in general is optional and may be omitted entirely. A user may add paper to the tray 14 through an open top, for example.

Although not shown, a control panel may be provided for use with the shredder 10 and may be provided on the machine itself or remotely associated therewith. A screen button, lights, LEDs, or other known devices may be provided on control panel. Generally, the use of a control panel is known in the art. The control panel can be provided to assist the user with the shredder 10 and communicate actions to the controller, e.g., to turn on the shredder mechanism (or off), start or set a timing mechanism or timer, activate or pause the shredder mechanism, lock access to the tray, etc.

The shredder 10 also includes a feed mechanism opposed to or adjacent the tray surface for advancing at least a top sheet from a stack of paper in a tray into the interleaved cutter elements 21 for shredding. That is, shredder 10 is designed with an advancement mechanism for automatically feeding one or more sheets to a shredder mechanism 20 without requiring a user to manually feed individual or a preset quantity of sheets into the cutting elements 21.

FIG. 2 shows in detail an embodiment of an advancement mechanism in accordance with the present invention comprising a movable feed mechanism 26. FIG. 2 illustrates detailed side view of a movable feed mechanism 26 for use in the housing 12 of shredder 10 of FIG. 1 in accordance with an embodiment of the present invention. The movable feed mechanism 26 is positioned above the tray 14 or bed 15, adjacent to the shredder mechanism 20. The feed mechanism 26 comprises at least one feed member 36 with a body 28 having at least one elastic arm 38 and a feed driver system designed to work in cooperation with the stack 22 in the tray 14. As shown, at least one feed member 36 of the feed mechanism is positioned above or adjacent to the bed 15 of the tray 14 for engaging and disengaging the stack with the at least one elastic arm.

In an embodiment, the at least one feed member 36 is mounted on the axle 34 for rotation (as indicated in FIG. 2 by arrow E) in a feeding direction (as indicated by arrow F in FIG. 2) with the at least one elastic arm 38. Each elastic arm 38 extends from a body 28 of the feed member 26 and elastically deforms to apply pressure and frictionally feed paper sheets atop the stack 22 to the cutter elements 21 during rotation thereof, as described below with reference to FIGS. 6-8. In an embodiment, the axle 34 is provided on a horizontal axis that is parallel to tray 14 and/or parallel to the parallel shafts of the cutter elements 21. The at least one feed member 36 is rotated on the axle 34 to engage and disengage the stack. The shape of the feed member 36 is designed such that as it rotates about the axis of axle 34, the elastic arm 38 engages and disengages with the top of the stack 22.

Figure 3:
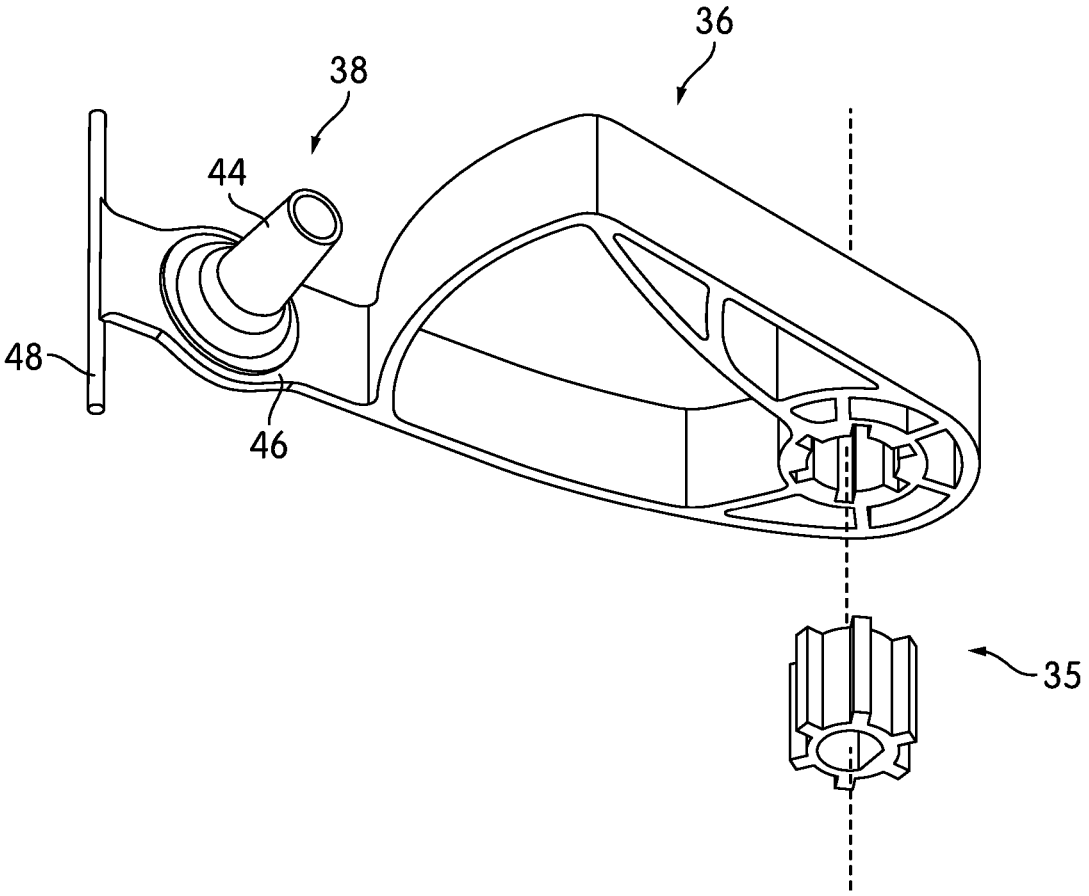
FIG. 3 illustrates a perspective view of a feed member that is part of the movable feed mechanism of FIG. 2 in accordance with an embodiment.

FIG. 3 illustrates a perspective view of an embodiment of a feed member 36 that is part of the movable feed mechanism 26. Feed member 36 has a body 28 with a mounting portion having an opening 33 therethrough. The body 28 is mounted to an axle, such as axle 34, for rotation therewith using the opening 33 of its mounting portion. An insert 35 or plug can be aligned and inserted into the opening 33 of the body 28 to ensure a tight fit with the axle. For example, the insert 35 includes an opening 37 that has a complimentary shape to axle 34, allowing the body 28 to be rotationally secured relative to axle 34 using its mounting portion, and such that as axle 34 is rotated, the feed member 36 rotates therewith.

The body 28 can be formed from a number of connected portions designed with openings therebetween or therein to accommodate bending or movement as the feed member 36 is rotated. For example, the body 28 can have at least two outer portions or ribs for possible contact with the stack 22 during rotation. The portions of the body 28 are not equidistantly spaced (radially) relative to the axle 34 of rotation when mounted thereon. In an embodiment, such as shown in FIG. 3, the body 28 can be an elongate body that extends radially from the axle 34 once mounted thereon. The connected portions of the body 28 can be formed in a radial direction outwardly from its mounting portion. For example, at one end, the at least two outer portions or ribs can be connected to and radially extend from the mounting portion (with the opening 33 therein) into the tray 14. The at least two outer portions can be connected to each other at their opposite ends (e.g., directly or via one or more other portions or ribs). The body 28 can have one or more openings, gaps, spaces, or cavities therein between the connected portions. The openings, gaps, spaces, or cavities can accommodate movement or bending of the connected portions during rotation (e.g., for receipt therein). In an embodiment, the body 28 is substantially hollow. Additional portions or ribs can connect between to the at least two outer portions of the body 28 and/or its mounting portion. In an embodiment, the body 28 has a web-like or a cage-like configuration in that includes a number of ribs interconnected with each other. Non-limiting examples of bodies 28 with interconnected ribs with openings for accommodating bending are shown in FIG. 3 as well as in FIG. 6, FIG. 12, and FIG. 14, for example.

The body 28 can be formed from one or more elastic materials. The body 28 and/or its parts can bend, deflect or elastically deform during rotation (e.g., outer portions or ribs can at least temporarily bend or deflect into openings or gaps between the connected portions or ribs), and, based on its elastic properties, for example, resume or return to its original shape after its compression.

Figure 14:
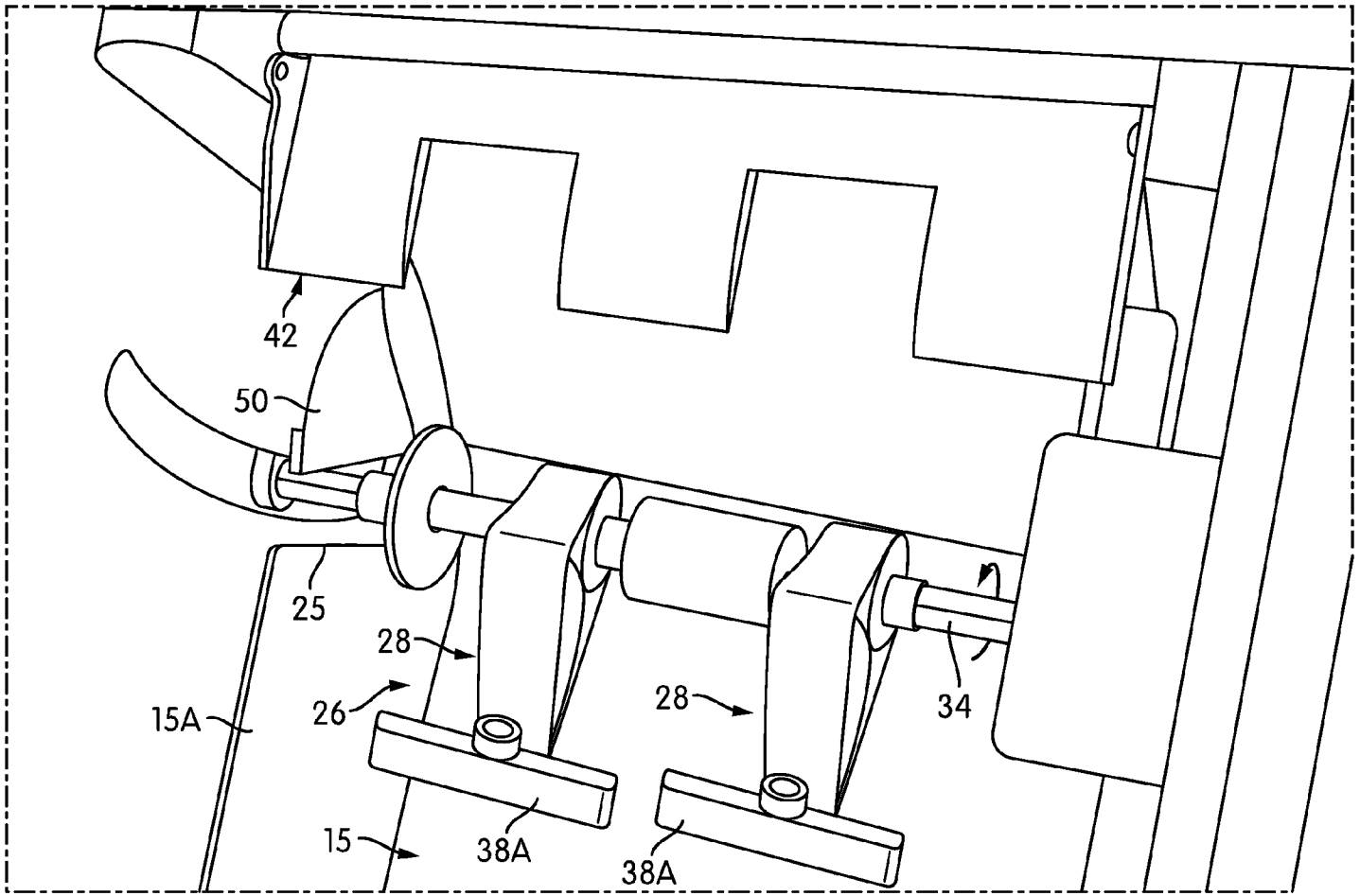
FIGS. 14 and 15 illustrate top views of the movable feed mechanism of FIG. 12 during use in the shredder of FIG. 1 in accordance with another embodiment of the present invention.

The at least one elastic arm 38 extends from the body 28 and includes an elongate body portion 46. The body portion 46 of the elastic arm 38 can extend further relative to and/or into the tray 14. In an embodiment, the body portion 46 of the elastic arm 38 extends in a longitudinal direction relative to the length of the tray 14. In an embodiment, the body portion 46 of the elastic arm 38 extends in a lateral direction relative to the width of the tray 14. In an embodiment, the elastic arm 38 extends both longitudinally and laterally from its body 28 and into the tray 14, e.g., such as shown in FIG. 3 or in an alternate design, as shown in FIG. 14 (see, e.g., arm 38A).

A proximal end of the elongate body portion 46 can connect to the connected at least two outer portions of the body 28, for example, and have a distal end extending into the tray 14. The proximal end of the body portion 46 of the elastic arm 38 acts like a bending or pivot point in that the elastic arm 38 can bend or pivot relative to the body 28 based on applied pressure. The elastic arm 38 extends a first distance or length from the body 28 when measured from the body 28 (e.g., from its pivot point at its proximal end) to its distal end.

As shown in FIG. 3, the elastic arm 38 can include optional fingers 48 or antenna at an end of the body portion. The optional fingers 48 or antenna can be thinner segments (relative to the elongate body portion 46) at the distal end of the elongate body portion 46. The first distance or length of the elastic arm 38 can be measured between its pivot point at its proximal end and the fingers 48, for example. The fingers 48, as shown, are not intended to be limiting by the illustrated design.

The fingers 48, as shown in FIG. 3, extend laterally from the elongate body portion 46 relative to the width of the tray 14, for example. The optional fingers 48 can be used to grab or grip smaller articles (e.g., envelopes) that could be positioned in the bed 15 in a place the elastic arm 38 itself might otherwise fail to contact. The optional fingers 48 also grip a surface of the article(s) in a lateral or horizontal direction (relative to the longitudinal direction of the tray 14, for example). That is, the optional fingers 48 increase the surface area that the elastic arm 38 grasps on top of the stack 22. Accordingly, the placement of articles or paper in the stack 22 need not be precise. That is, the extension of fingers 48 in the lateral direction relative to the tray allows for a user to place articles or paper or a stack 22 into the feed bed 15 of the tray without concern for exact alignment, order, and/or relative positioning of the articles in the stack 22 (e.g., documents do not necessarily need to be straight).

In accordance with an embodiment, each elastic arm 38 is formed such that its body portion 46 extends in the lateral direction like fingers 48 (e.g., see FIG. 14, arm 38A). Thus, the arm 38 itself can be formed to act like fingers 48 (and thus such optional fingers 48 are not necessarily required).

In an embodiment, the surface of the elastic arm 38 and/or fingers 48 can be altered to improve its grip on at least the top sheet(s) in the stack. For example, the elastic arm 38 and/or fingers 48 can include a raised pattern or design. In an embodiment, a strip of material (e.g., a rubber strip, with or without a pattern or design) (not shown) can be provided on the elastic arm 38, its body portion 46, and/or fingers 48 to aid in the gripping force applied to the stack 22 during rotation of the feed member 36.

Figure 6:
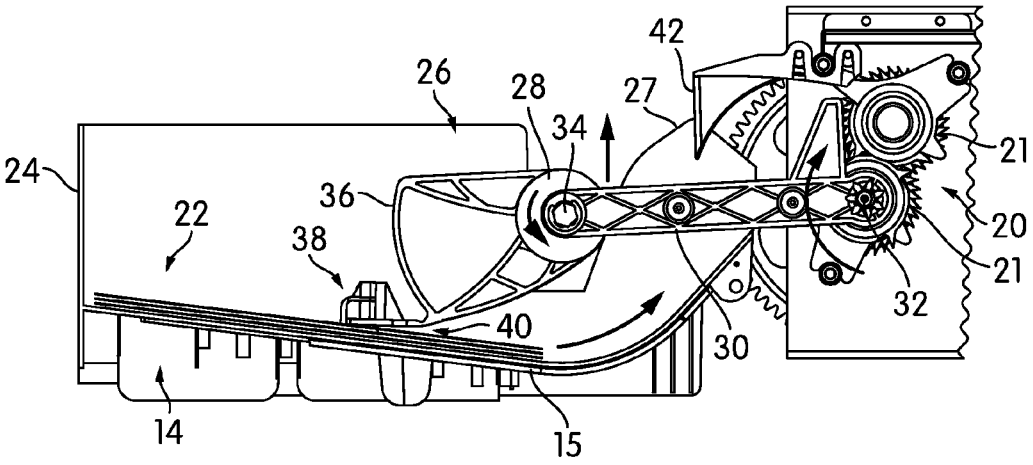
FIGS. 6, 7, and 8 illustrate side views of the movable feed mechanism in operation for advancing paper in accordance with an embodiment of the present invention.
Figure 7:
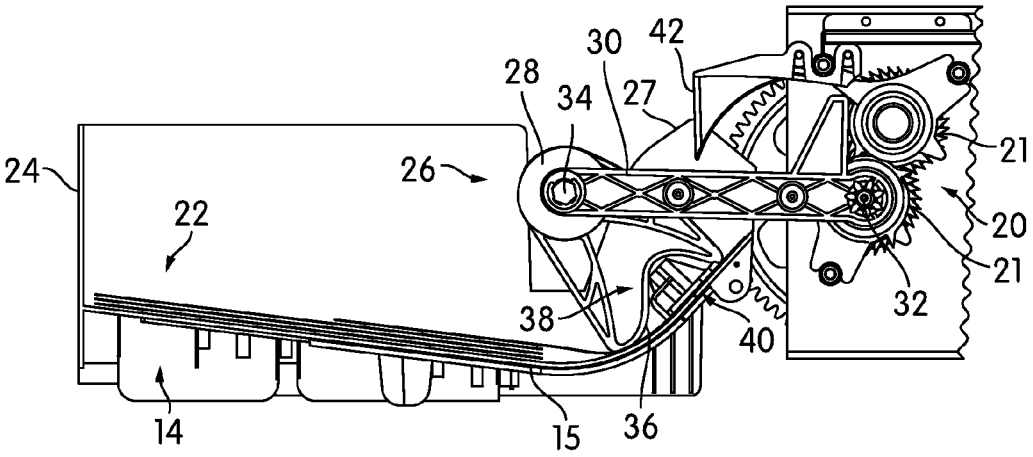

The elastic arm 38 works cooperatively with the curved feed bed 15 of tray 14 as the feed member 36 is rotated. As described below with reference to FIGS. 6-8, each feed member 36 is configured to rotate 360 degrees about a horizontal axis via axle 34 and to elastically deform during said rotation. The elastic arm 38 is moved from being extended away from the body 28 when it initially contacts the stack 22, e.g., as shown in FIG. 6, and compressed or deformed against and, in some cases, into body 28 as the feed member 26 is rotated, e.g., as shown in FIG. 7. That is, the body 28 itself (e.g., one or more of its connected portions or ribs) can be at least partially deformed to temporarily receive and accommodate the compressed elastic arm 38 in its openings, gaps, etc., e.g., as it rotates and moves along a length of the tray 14 and along the front or proximal end of the bed 15. Referring to FIG. 7, for example, as each feed member 36 continues to rotate axially using axle 34, the pressure against curved feed bed 15 causes compression of at least the elastic arm 38 against and/or into the body 28 of the feed member 36. Accordingly, it can be seen that the distance or length of the elastic arm 38 as measured relative to the body 28 changes during rotation and compression. The curve of the feed bed 15 pushes the distal end of the elastic arm 38 closer to the axis point of the rotating elastic arm by bending or pivoting the elastic arm 38 about its pivot point at its proximal end. More specifically, the compression force on the elastic arm 38 from the curved feed bed 15 deforms and bends arm 38 towards the body 28. Its distal end can be positioned against an outside end of the body 28, optionally deforming an outer portion or rib of the body 28 itself for receipt and accommodation of the distal end, as shown in FIG. 7. In this compressed position, the distal end of the elastic arm is provided at a second distance or length relative to the body 28. Specifically, the second distance or length between the distal end of the elastic arm 38 and the body 28 (e.g., at proximal end of elastic arm 38) during compression of the elastic arm 38 is less than the first distance between the distal end of the elastic arm 38 and the body 28 (e.g., at proximal end of elastic arm 38) during its extension and when out of contact with the curved feed bed 15. Thus, at least each elastic arm elastically deforms to apply pressure to feed paper sheets atop the stack to the cutter elements.

As the feed member 36 continues to rotate, the elastic arm 38 is guided along the front end (the end positioned at an angle B) and moves or snaps out of contact with the curved feed bed 15 (into its extended position). This releasing movement of the elastic arm 38, or decompression resulting from the resiliency of the arm, releases the pressure and frictional contact or force applied to the gripped sheet(s). Further, the elasticity of the arm enhances the feeding of the gripped sheet(s) into the shredder mechanism 20 because the decompression or movement of the arm 38 results in the arm 38 snapping into its extended position (relative to the body 28), and thus applies a pushing or shoving force to the gripped sheet(s) towards the cutter elements 21. This pushing, snapping, or shoving force is generated by the resiliency and releasing of the elastic arm, and further advances the gripped sheet(s) into the cutter elements. The elastic arm 38 returns to an extended position relative to the body 28 of the feed member 36 and out of contact with gripped sheet(s).

Further, the elastic arm 38, as shown in FIG. 3, is not intended to be limiting by the illustrated design. For example, the elastic arm 38 may be formed to extend horizontally relative to a longitudinal tray 14 or bed 15, such as shown by arm 38A on each of the feed members 36 in FIG. 12 and FIGS. 14 and 15.

Figure 4:
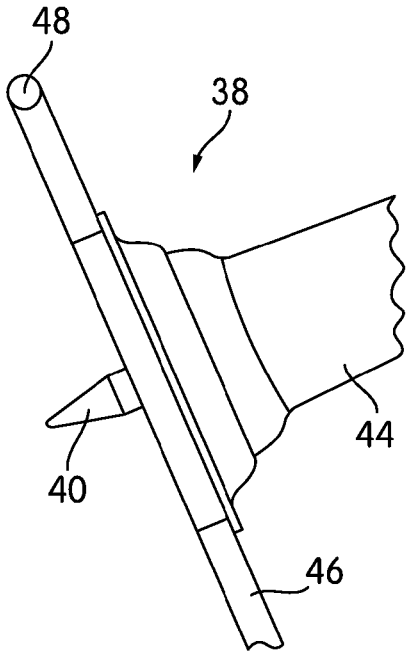
FIGS. 4 and 5 illustrate detailed side and bottom perspective views of an end of the feed member of FIG. 3 in accordance with an embodiment.
Figure 5:
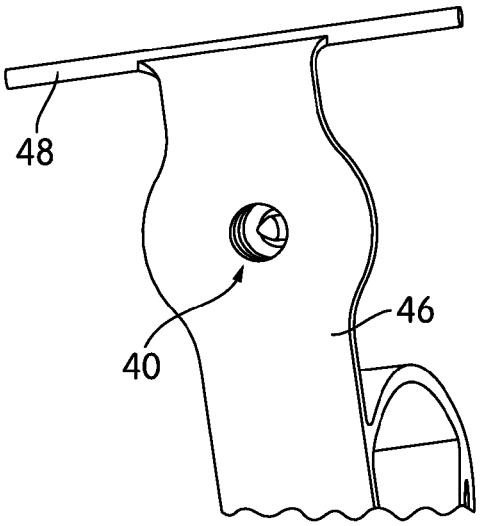

In an embodiment, the at least one elastic arm 38 has a protruding tip 40, shown in FIGS. 4 and 5. The protruding tip 40 is designed for insertion into the stack 22 as the at least one elastic arm 38 applies pressure to the paper sheets atop the stack 22 during rotation of the at least one feed member 36. The protruding tip 40 can help grab more than one sheet from the top of the stack 22, for example. The first distance or length of the elastic arm 38 can be measured between its pivot point at its proximal end and the protruding tip 40, for example. The protruding tip 40 may be selectively retracted and extended from the elastic arm 38. For example, a holder 44 or housing (e.g., shown in FIG. 3) can be provided on the elastic arm 38 for the protruding tip 40. As shown in FIG. 5, the needle 40 can be provided in a retracted position within the housing 44 relative to a bottom (i.e., a portion for contact with the stack 22, or contact portion) of the body portion 46 of the elastic arm 38.

During rotation of the feed member 36 (via rotation of axle 34), the at least one elastic arm 38 elastically deforms to apply pressure to and snaps back into its original shape to frictionally feed paper sheet(s) atop the stack 22 to the cutter elements 21. For example, at least the elastic arm 38, and (optionally) part of the body of the feed member 36 itself, is designed for compression against the stack 22, such as shown in FIG. 7, which can thereby press or move the protruding tip 40 (out of the housing 44), as shown in FIG. 4, for engagement with and/or into the stack 22. Each feed member 36 continues to rotate via axle 34 (each turn being 360 degrees) and elastically deforms during said rotation. The distance between the protruding tip 40 and the body 28 during compression of at least the elastic arm 38 is less than the first distance as measured during extension of the elastic arm 38. When the feed member 36 snaps back into its original shape after its temporary deformation (e.g., upon release of contact with curved feed bed 15 and thus release of stress thereon, its elasticity and resiliency causes it to move back to its extended position), it further aids in forcing sheet(s) into the interleaved cutter elements 21.

Thus, the body 28 is formed such that pressure against curved feed bed 15 causes compression of at least the elastic arm 38 against and/or into the body 28 of the feed member 36 and further or deeper insertion of the optional protruding tip 40 into the stack 22 as it drives the sheet(s) from the stack 22 up the curved surface of the curved feed bed 15. The body 28 is also formed such that decompression of at least the elastic arm 38 after disengagement from the curved feed bed 15 causes a snap force that aids in feeding sheet(s) (forwardly) into the cutter elements 21 for shredding.

In an embodiment, the protruding tip 40 is provided in the form of a needle. In an embodiment, the protruding tip 40 is provided in the form of a pin.

In an embodiment, each feed member 36 is integrally molded as a single part (e.g., body 28, elastic arm 38, fingers 48, etc.). In an embodiment, the parts can be molded separately and adhered together. The insert 35 can be added to the feed member 36 after molding, or overmolded. In an embodiment, an insert 35 need not be used, i.e., the opening 33 can be formed to cooperatively fit with the axle 34. The protruding tip 40 can be pushed or inserted through the elastic arm 38 (e.g., into housing 44) after its molding or forming. The protruding tip 40 can be designed such that it is held within and not removable from the housing 44 once inserted (e.g., via a barb, flange, adhesive, etc.). Further, a specific housing 44 need not be provided. That is, the elastic arm 38 itself can accommodate the acceptance and insertion or addition of a needle, pin, or other type of protruding tip 40.

In an embodiment, similar or the same materials are used to form parts of the body 28 and the at least one elastic arm 38. In an embodiment, different materials are used to form parts of the body 28 and the at least one elastic arm 38.

In an embodiment, the feed member 36 is formed from a material having a durometer between approximately 70 to approximately 75 Shore A (inclusive).

In an embodiment, the movable feed mechanism 26 comprises two feed members 36 adjacent to the tray, such as shown in FIG. 1. Each feed member 36 has one elastic arm 38 and both are mounted on the axle 34. Each elastic arm 38 can include a protruding tip 40 for insertion into the stack of paper sheets as the feed members rotate in the feeding direction (arrow F).

In an embodiment, the movable feed mechanism 26 includes one or more articulating or pivot arms 30, as shown in FIG. 1, for example. The pivot arms 30 can be used along with other gears or devices to rotate the axle 34 and thus rotate the feed members 36 mounted thereon. Further, in an embodiment, the pivot arms 30 are used to move the one or more feed members 36 between a lowered position for engaging the stack 22 to feed paper and a raised position for disengaging from the stack during rotation of the at least one feed member 26. More specifically, one end of each arm 30 is configured for pivoting, while another end of each arm 30 is connected to axle 34. The arms 30 may be configured to pivot about an axis 32 within the housing 12, as shown by arrow C in FIG. 2, and thus move axle 34. For example, the arms 30 may be configured to move in a reciprocating fashion between the lower and raised positions in a vertical direction, as shown by arrow D in FIG. 2, relative to the stack 22 in the feed bed 15, and thus move axle 34 and feed members 36 thereon vertically relative to the feed bed 15.

A right side view of parts in the housing 12 are only shown in FIGS. 2 and 6-11. However, it should be understood that parts on a left side are substantially similar to those shown and described in detail below.

The movable feed mechanism 26, therefore, is designed to both rotate the feed member 36 and articulate the pivot arms 30 during said rotation such that frictional force can be used to grasp and feed paper picked from atop a stack 22 into the shredder mechanism 20. As the pivot arms 30 are moved between the lowered position and the raised position, the protruding tip 40 of the at least one elastic arm can remain inserted into the stack 22 or sheets grasped from atop the stack 22. Further, the protruding tip 40 of the at least one elastic arm 38 is configured exert greater pressure on the stack 22 via driving the protruding point into the stack 22 of paper pressing itself and the paper against an opposing (curved) surface of the tray 14 as the pivot arm is moved between the lowered position and the raised position and as at least the elastic arm 38 is temporarily compressed and deformed as it moves about the curved feed bed 15 (during rotation of the feed member 36). The arm 30 can be moved relative to the tray 14 or feed bed 15 so as to allow rotation about axle 34 and deformation of at least the elastic arm 38 of each feed member 36 and rotation thereof while still providing friction to any picked articles or sheets.

Accordingly, the shredder 10 includes a feed driver system constructed and arranged to drive the at least one feed member 36 to rotate about a (horizontal) axis in a feeding direction (arrow F) (via rotation of axle 34) with the at least one elastic arm 38 thereof elastically deforming to apply pressure and frictionally feed paper sheets atop the stack 22 to the cutter elements 21 of the shredder mechanism 20. In an embodiment, the feed driver system is also constructed and arranged to also pivot the pivot arm 30 such that the at least one feed member 36 is moved relatively down into engagement with the stack 22 and out of engagement with the stack 22 as the feed member 36 rotates 360 degrees about its axis on axle 34.

In an embodiment, the shredder 10 includes a driver for moving the at least one feed member 36 and its at least one elastic arm 38 between the lowered and raised positions and a rotary driver connected to the at least one feed member 36 for its rotation.

In an embodiment, the feed driver system includes a driver for rotating the axle to drive an axle 34 to rotate two feed members 36 about an axis in the feeding direction with their elastic arms 38 elastically deforming to apply pressure and frictionally feed paper atop the stack 22 to the cutter elements 21.

The number of feed members 36 mounted on axle 34 is not intended to be limiting. In an embodiment, the movable feed mechanism 26 has a plurality or array of feed members 36 with elastic arms 38 provided for rotation along axle 34. A plurality of feed members 36 aids in covering a greater length or width of the tray 14 (in a horizontal direction) and thus aids in grasping and feeding at least the top sheet(s) of paper from the stack 22.

In an embodiment, the pivot arm 30 is rotated about its axis 32 using a motor(s) and/or drive wheel mechanism(s). In an embodiment, the rotation of the axis 32 of the pivot arm 30 is driven based on the rotation of the shredder mechanism 20. In an embodiment, the pivot arm 30 is articulated and activated for rotation using the same motor 23 used to drive the shredder mechanism 20. In an embodiment, the pivot arm 30 can be free floating about its pivot point on axis 32. The axis 32 can be a same axis as one of the parallel axes of the cutter elements 21 (e.g., see FIG. 2 and FIG. 12). The arms 30 may move cyclically with respect to the shredder mechanism 20 when the shredder mechanism 20 is activated. For example, the rotation of the pivot arm 30 may be linked or connected by belts, axles, or gears, as known in the art, to rotate upon activation of the cutter elements 21 in the shredder mechanism 20. In an embodiment, the pivot arm 30 uses a separate motor for articulation.

In an embodiment, the axle 34 and thus feed member(s) 36 of the movable feed mechanism 26 is rotated about its axis using a motor(s) and/or drive wheel mechanism(s). In an embodiment, the rotation of the axle 34 is driven based on the rotation of the shredder mechanism 20. In an embodiment, axle 34 is activated for rotation using the same motor 23 used to drive the shredder mechanism 20. For example, the rotation of the axle 34 may be linked by belts, axles, or gears, as known in the art, to rotate upon activation of the cutter elements 21 in the shredder mechanism 20. In an embodiment, the axle 34 uses a separate motor for rotation.

Figure 12:
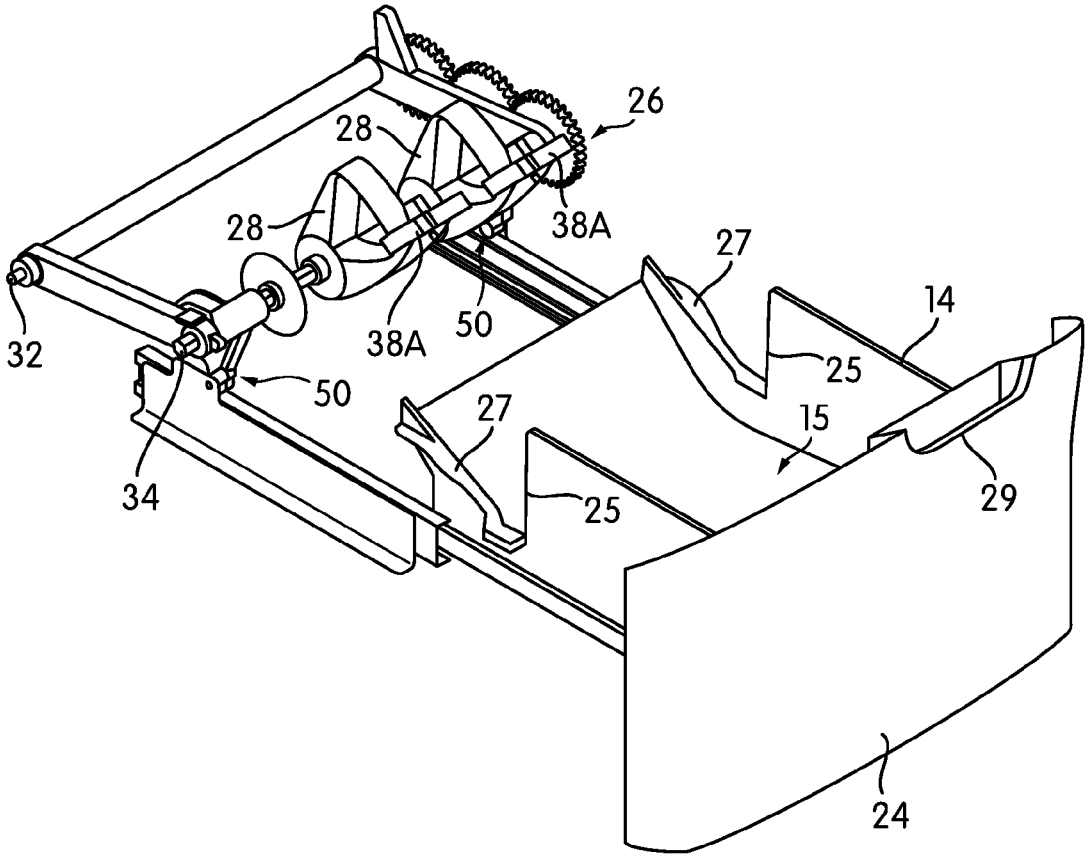
FIG. 12 illustrates a perspective view of the drawer, tray, and movable feed mechanism in accordance with an embodiment.

The rotating feed members 36 and axle 34 can be connected to a spur gear (drive gear) on the axis 32, i.e., an axle or shaft of the cutter elements 21 (as seen in FIG. 2). In an embodiment, several gears or a gear train (e.g., see FIG. 12, showing three gears configured for rotation via rotational movement of the axle on axis 32) can be used to rotate axle 34. Thus, as an axle of the cutter elements 21 is rotated, the gears and thus the axle 34 is rotated. In an embodiment, a chain could be used to link an axle along axis 32 or a spur gear (drive gear) on the axis 32 to a driven gear residing on axle 34 for rotation thereof.

In an embodiment, each feed member 36 and/or pivot arm 30 is removable or replaceable, for example, if damaged.

In an embodiment, a deflector device 42 is provided. The deflector device 42 has a paper deflecting surface provided above the shredder mechanism that is configured to deflect and direct paper grasped fed by the at least one feed member 36 of the movable feed mechanism 26 into the shredder mechanism 20. FIG. 2 and FIG. 14 show examples of a positioning and use of a deflector device 42, for example. The deflector device 42 may be designed such that it at least partially surrounds or at least is positioned adjacent the movable feed mechanism 26 in the shredder 10, while still providing clearance for its rotation. The deflector device 42 is used to ensure direction and feeding of the picked or separated articles or paper sheet(s) into the cutter elements 21 of the shredder mechanism 20.

Figure 15:
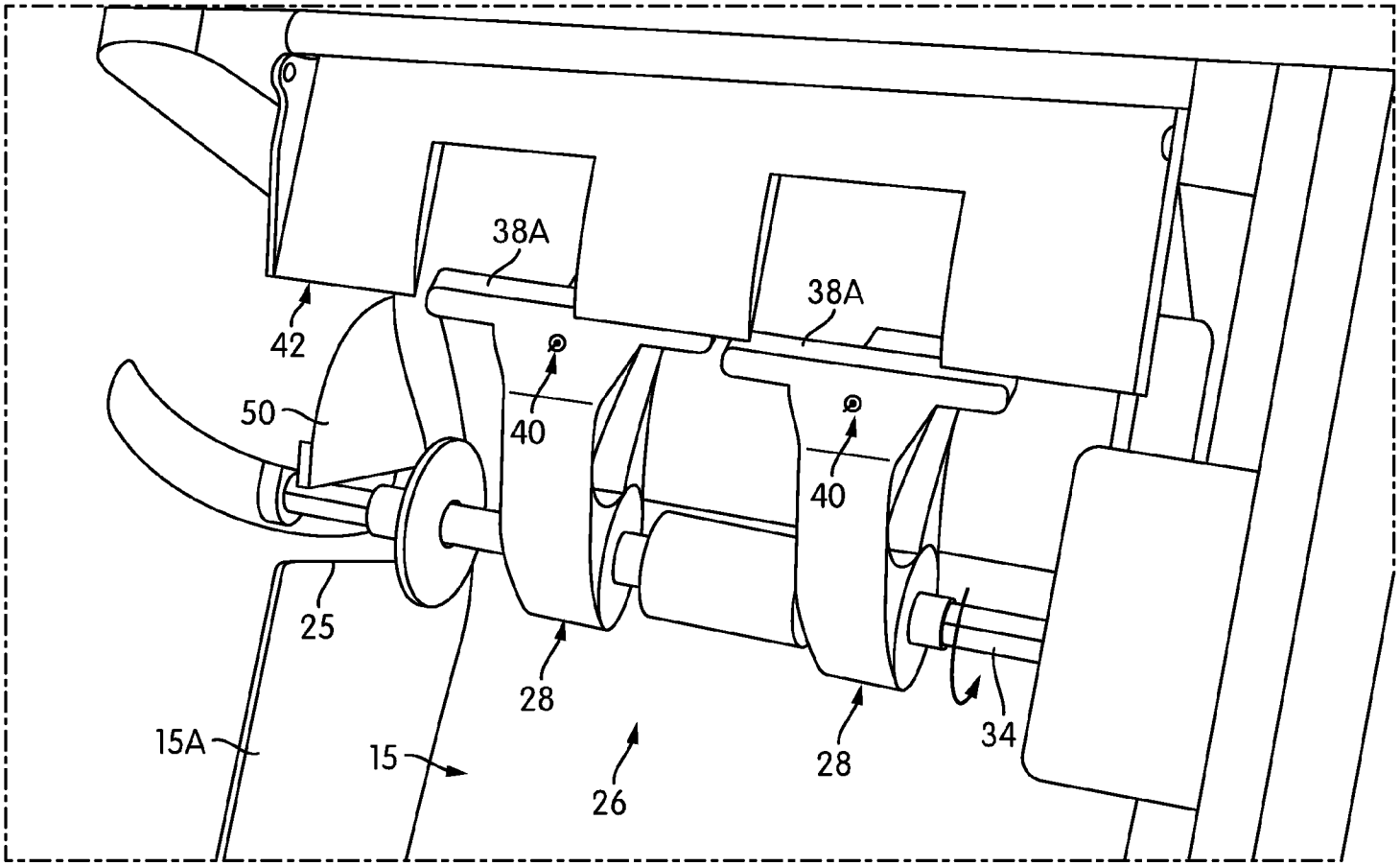
Figure 16:
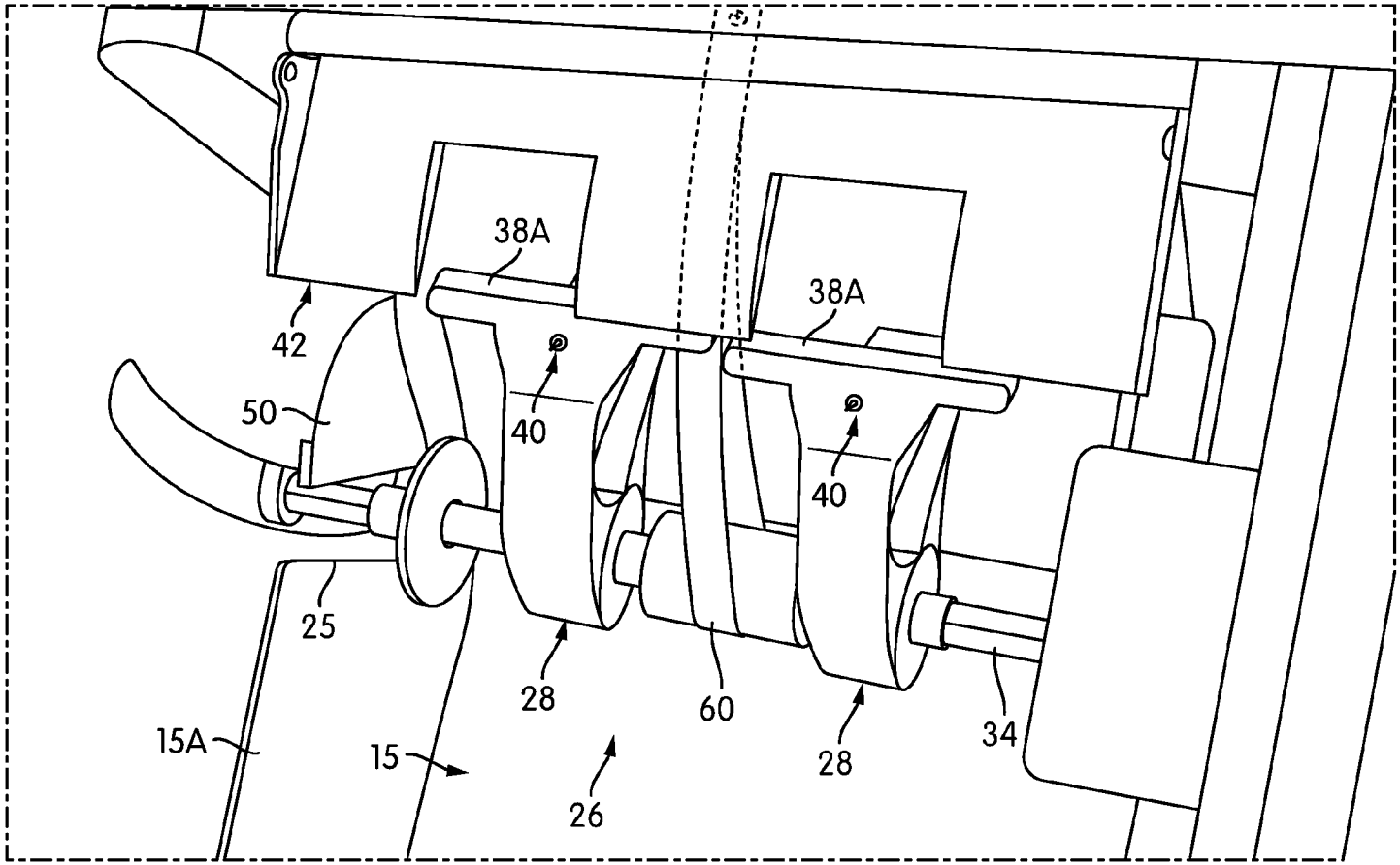
FIG. 16 illustrates a top perspective view of an optional strap for use with a movable feed mechanism.

FIG. 16 illustrates a top perspective view of an optional strap 60 for use with the movable feed mechanism 26 of FIGS. 14 and 15. The strap 60 can be used as a deflector to keep paper from wrapping around the axle 34 and/or feed members 36 during rotation. For example, if the gripped sheet(s) are not fed or directed into the cutters 21, the strap 60 prevents the sheet(s) from rotationally moving around with the feed members 36 of the feed mechanism 26. In an embodiment, strap 60 is used in addition to a deflector 42 (as shown). However, use of deflector 42 is optional and need not be provided.

In an embodiment, the deflector 42 or strap 60 can further be used to guide paper during an auto-reverse situation of the cutters 21 of the shredder mechanism 20. For example, the shredder mechanism 20 can be configured to rotate the axles of the cutter elements 21 in an opposite rotational direction (opposite to the shredding direction) upon detection of overload or over limit of fed sheet(s). For example, if the number or thickness of sheet(s) that are fed to the cutter elements is exceeded, a controller can be used to auto-reverse the rotation of the cutter elements 21. The deflector 42 and/or strap 60 can then guide sheet(s) during such auto-reverse situations so as to help guide the sheet(s) back into the tray 14 or drawer 24.

Figure 8:
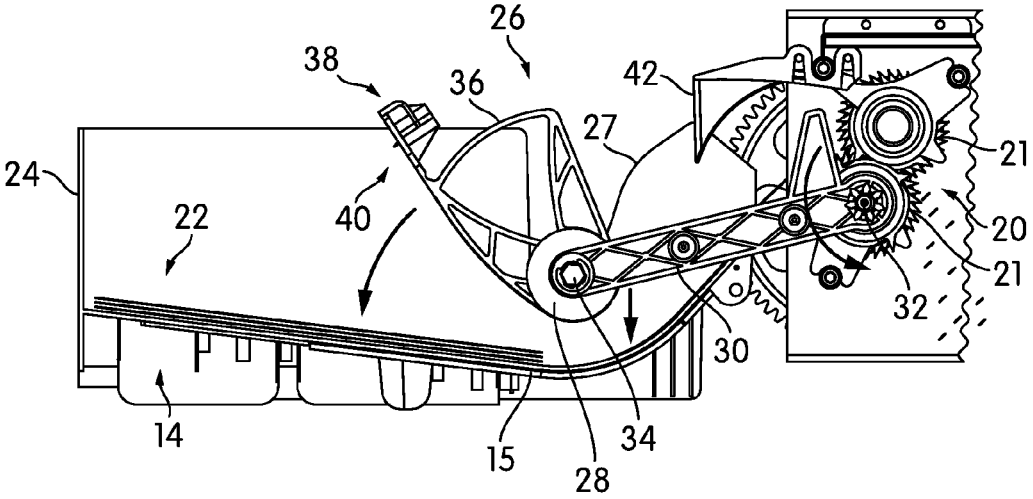

FIGS. 6, 7, and 8 illustrate side views of the movable feed mechanism in operation for advancing paper in accordance with an embodiment of the present invention. As previously noted, the feed driver system (not shown) of shredder 10 is constructed to rotate and move the movable feed mechanism 26 and its parts. The feed driver system (not shown) is constructed and arranged to rotate the axle 34 and thus the feed member 36 in a feeding direction with the at least one elastic arm 38 to engage and feed paper atop the stack 22 in the bed 15 of the tray 14 to the cutter elements 21 of the shredder mechanism 20, and move the pivot arms 30 and thus the feed member 36 in an alternating manner between a lowered and raised position relative to the feed bed 15 of the tray 14 (e.g., in a substantially vertical direction), such that the feed member 36 alternates between engaging the stack 22 with the at least one elastic arm 38 to feed paper and disengaging from the stack 22 to allow the cutter elements to advance the paper therethrough.

When the shredder 10 is activated, the feed members 36 are lowered to the lower position such that at least the elastic arms 38 engage the top of the stack 22, as shown in FIG. 6. The feed drive system activates and rotates the feed members 36 such that at least a top sheet of the stack 22 is fed into the shredder mechanism 20. Specifically, the feed members 36 are rotated about their axle 34 and the elastic arms 38 are moved into contact with at least a top sheet of the stack 22. As the bodies 28 of the feed members 36 rotate, the elastic arms 38 (e.g., body portion 46 and/or fingers 48) grasp at least the top sheet for advancement and feeding. As the sheet(s) 30 is (are) fed forward, the pivot arms 30 are articulated upwardly towards a raised position, and thus feed members 36 move to a raised position, as depicted in FIG. 7. Further, the elastic arms 38 elastically deform against the curvature of the proximal end of the feed bed 15 and apply pressure to at least the picked or separated top sheet. The protruding tips 40 can be extended from the elastic arms 38 during its contact with the stack 22 and rotation of the feed member 36. For example, during rotation of the feed member 36, at least each of the elastic arms 38 compresses as it makes contact with the stack 22 in the curved feed bed 15. That is, for about 180 degrees of the full rotation, the elastic arms 38 compress against the bed 15 to create a frictional force forcing the paper into the cutters 21. A secondary action can take place as the elastic arms 38 are deformed and moves up the curved feed bed 15, as shown in FIG. 7. The protruding arms 40 can extend out of the end of each of the elastic arms 38 and be inserted (e.g., puncturing or piercing) into at least the top sheet of the stack 22 to help feed the paper towards the shredder mechanism 20 as the feed members 36 rotate in the feeding direction (as the elastic arm 38 applies pressure to the paper sheet(s) and is moved along and deformed against the curvature of the curved feed bed 15). The protruding tips 40 can aid in grasping, for example, lower friction paper or slippery stock, such as glossy paper, that is provided in the stack 22 by piercing through at least a portion of the sheet(s), and thus reduce or prevent multiple passes of the feed member 36 to move such articles towards and into the shredder mechanism 20. The sheet(s) are then grasped and pulled (e.g., by their ends) into the shredder mechanism 20 by the cutter elements 21. As the feed members 36 continue its 360 degree rotation, the elastic arms 38 are moved out of contact with the curved feed bed 15 and the pressure on the gripped sheet(s) is released. As the pressure and frictional contact with the gripped sheet(s) is released, the elasticity of the arm enhances the feeding of the gripped sheet(s) into the shredder mechanism 20 by applying a pushing force to the sheet(s) towards the cutter elements 21. The elastic arms 38 thereafter return to an extended position relative to the body 28 of their associated feed member 36. The feed members 36 are then moved back to the lowered position, as seen in FIG. 8, to thus allow the elastic arms 38 to re-engage the stack 22 and advance the next or top sheet(s) into the shredder mechanism 20.

The advantage of raising and lowering the feed members 36 in an upward and downward movement is that it reduces jamming from occurring and accommodates the deformation of the elastic arms 38 as the axle is rotated. Additionally, a curved feed bed 15 also aids to prevent jamming.

The variability of the curve of the curved feed bed 15 along with the force exerted by at least the elastic arms 38 of the feed members 36 (and optional fingers 48 or rubber strip) on the curved portion of the tray 14 can all be considered and to control an amount of paper entering into cutter elements 21 per rotation of the elastic arms 38.

In an embodiment, the movement of the feed members 36 need only be used to advance sheet(s) partially, such that the cutter elements 21 themselves grasp and pull the rest of the sheet(s) therebetween.

FIGS. 12, 14 and 15 illustrate another embodiment of a feed member 36 for use in movable feed mechanism 26. Each feed member 36 includes a body with an elastic arm 38A on an end thereof that is configured to operate in a similar manner as described with reference to the feed member 36 shown in FIG. 3. As shown in FIG. 12 and FIG. 14, each feed member 36 is provided on an axle 34 for rotation therewith to feed articles from the curved feed bed 15 towards and into the shredder mechanism. Although not necessarily repeated here, it should be understood that the use of similar reference numbers in FIGS. 14-16 demonstrate similar features of a shredder mechanism as described herein. That is, the movable feed mechanism 26 as shown in FIGS. 12 and 14-15 is designed for feeding articles or paper from the stack 22 in a curved feed bed 15 by driving the feed members 36 to rotate in a feeding direction with the their elastic arms 38A elastically deforming to apply pressure and frictionally feed paper sheets atop the stack 22 to the cutter elements 21 when it is providing in an operating or operable position adjacent to the tray 14 and shredder mechanism 20. As shown in FIG. 15, protruding tips 40 or needles can be provided on each elastic arm 38A of the feed mechanism for insertion into the stack 22 of paper sheets as the elastic arm 38A applies pressure to the paper sheets atop the stack 22 (e.g., as shown in FIG. 14) during rotation of the feed members 36 using axle 34. Also, pivot arms 30 can be provided on either side of the axle 34 for articulating the axle 34 and thus the feed members 36 between a lowered position for engaging the stack and a raised position for disengaging from the stack during rotation and use of the movable feed mechanism 26.

In accordance with an embodiment, the feed mechanism 26 may be moved or lifted to a third position, i.e., an inoperative or inoperable feed position away from the stack in the tray 14. For example, in an embodiment, when the drawer 24 of the shredder is moved or pulled out to its open position, at least the feed members 36 of the feed mechanism 26 are moved up or lifted up to a higher position away from the feed bed 15 of the tray 14 such that paper or articles may be inserted into the feed bed 15 of the tray 14, e.g., via movement of the axle 34 and pivot arms 30. Further, the feed members 36 can be inhibited from rotation. After insertion of the articles into the stack 22, the drawer 24 can be pushed or moved to its closed position adjacent to the shredder mechanism 20.

Figure 10:
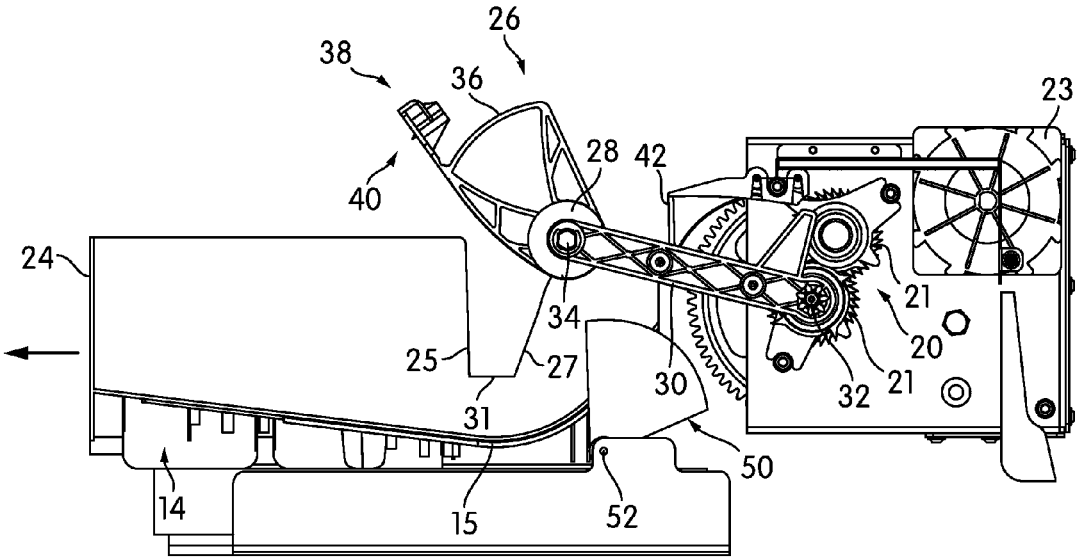

To lift the feed mechanism 26 into its third or inoperative feeding position when the drawer 24 is moved or slid into the open position (e.g., by pulling on handle 29), the drawer includes a guide channel with an opening 25 with guide walls 27, such as shown in FIG. 2 and FIG. 10. The walls 27 are designed at an angle to direct movement of the at least one feed member 36 of the feed mechanism 26 into the inoperable feeding position (away from the tray 14) as the drawer 24 is pulled outwardly away from the shredder mechanism 20. The axle 34 is guided from the opening 25 along the guide walls 27 in an upward or angled direction as the drawer 24 is moved. The pivot arms 30 are pivoted about axis 32 in an upward direction away from the tray 14.

In an embodiment, the pivot angle of the pivot arms 30 is about 30 degrees to about 40 degrees. However, such angles are not intended to be limiting. The pivot angle for the pivot arms 30 can vary depending on a depth of the tray 14 and a total rated quantity for the machine (e.g., the higher the stack of paper, the larger the degree of movement needed to disengage with the stack when the drawer is open).

To hold or maintain the axle 34, the pivot arms 30, and thus the feed mechanism 26 in the inoperable feeding position when the drawer 24 is in the open position, at least one disengagement mechanism 50 or retainer is provided adjacent to the feed mechanism 26. In an embodiment, a disengagement mechanism 50 is provided near either end of the axle 34 (e.g., see FIG. 12 or FIG. 13). The disengagement mechanism 50 can be in the form of a paddle that is configured for movement between a retracted position away from the feed mechanism 26 and an extended position in contact with the feed mechanism 26. For example, paddles can be mounted for pivotal rotation about an axis at a point 52 on either side of the housing 12. The paddle can include a top surface for holding the axle 34 in the inoperative position (e.g., see FIG. 13). The disengagement mechanism 50 can be moved and placed in an extended position when the drawer is in the open position, and hold the at least one feed member 36 and feed mechanism 26 in the inoperable feeding position away from the tray 14. The drive axle 34 travels up the walls 27 of the guide channel and then onto the top surface of the biased retainer 50.

The paddles 50 rotate about pivot points 52 into and out of activation to lift and/or hold and release the axle 34. A torsion spring can be provided at each pivot point 52 to bias the retainer 50 in an upright or extended position when the drawer 24 is in the open position. Thus, as the drawer 24 is moved away from the shredder mechanism 20, the retainer 50 pivots as a result of the force from the torsion spring from a storage position to an extended holding position when the drawer is pulled out. The action of closing the drawer 24 pushes the retainer 50 about the pivot point 52 past the upright or extended position against the torsional force of the torsion spring via pivoting it downwardly so as to release the drive axle 34 (from the top surface of the retainer 50) as to allow the drive axle 34 to be guided back towards the stack 22.

Figure 9:
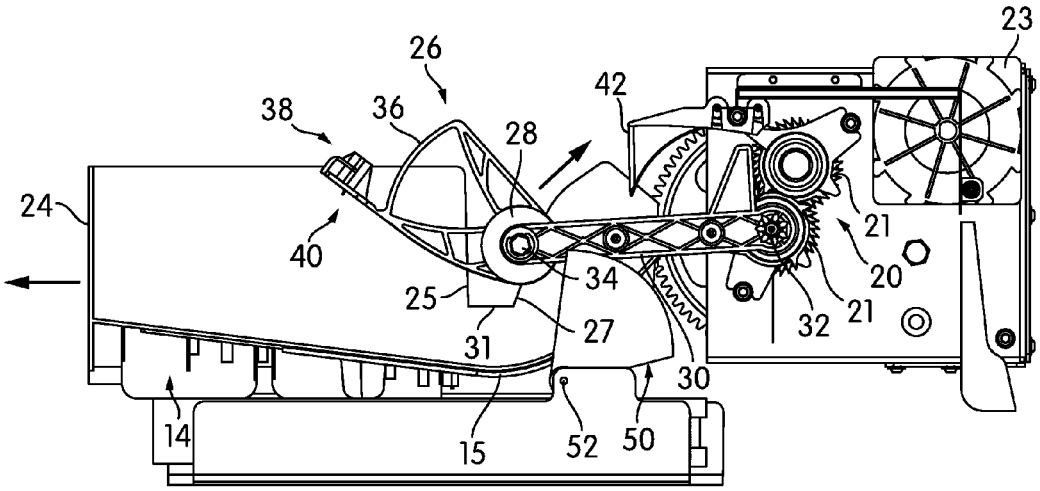
FIGS. 9, 10, and 11 illustrate side views of the shredder of FIG. 1 as the movable feed mechanism moves into an inoperative position and is held by a disengagement mechanism as a drawer and tray of the shredder are moved to an open position, in accordance with an embodiment.
Figure 11:
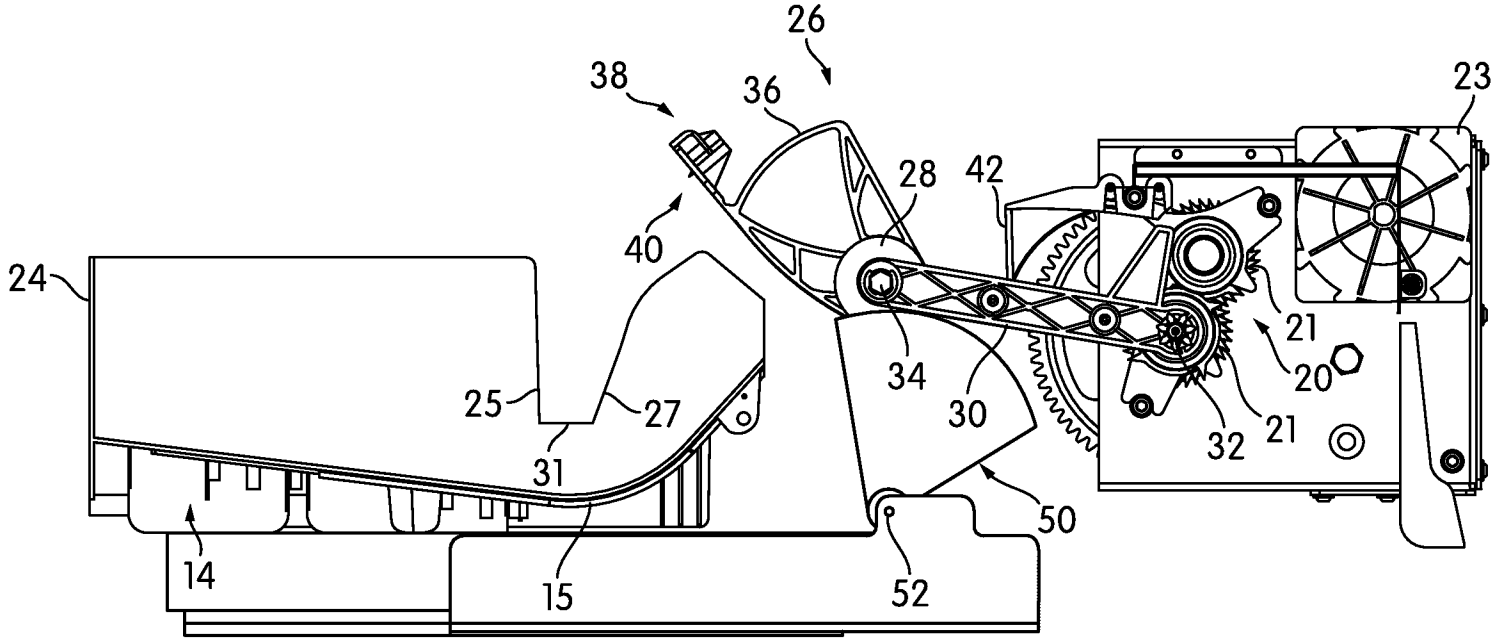
Figure 13:
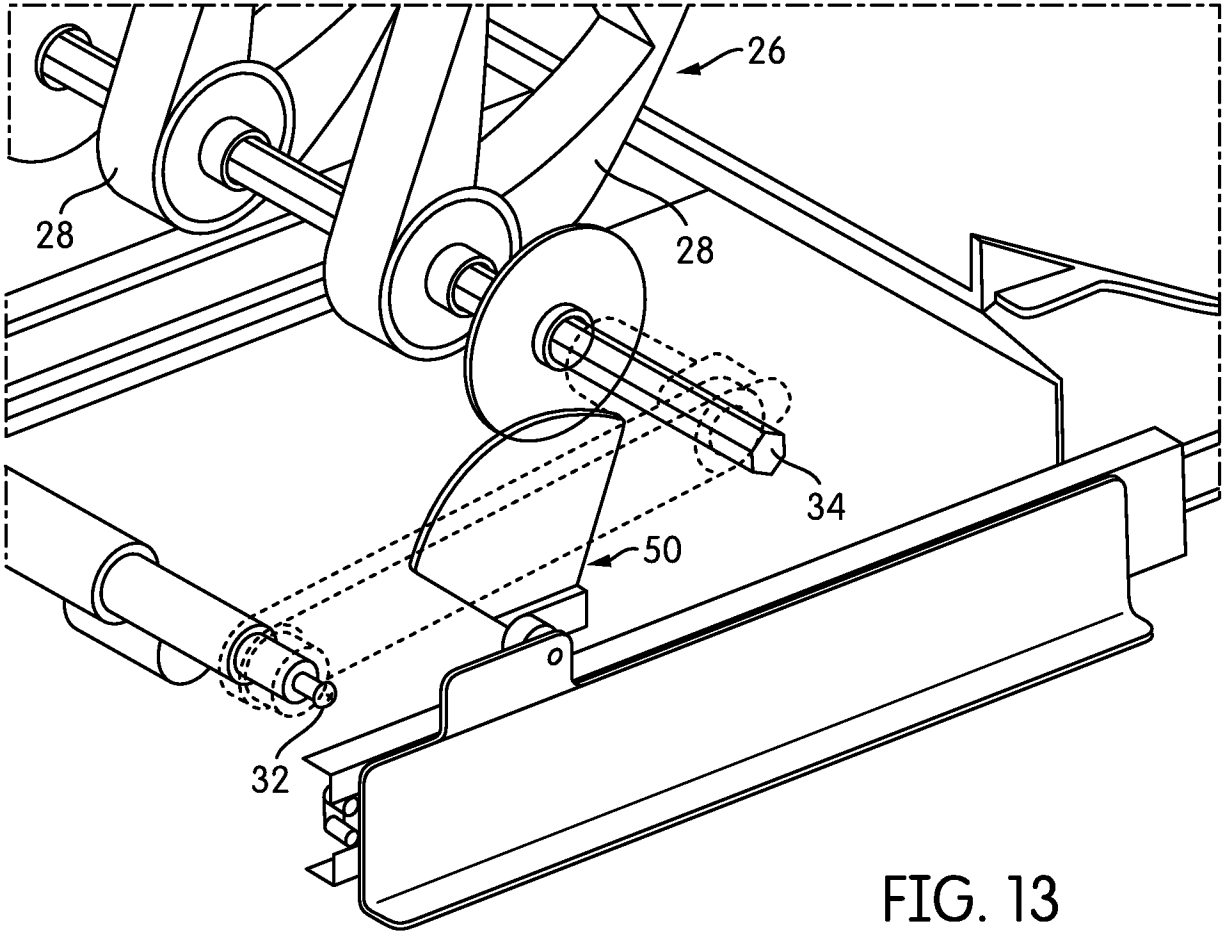
FIG. 13 illustrates a detailed, rear perspective view of the drawer, tray, and movable feed mechanism of FIG. 12, showing the disengagement mechanism in use, in accordance with an embodiment.

FIGS. 9, 10, and 11 illustrate side views of the shredder of FIG. 1 as the feed mechanism 26 moves into an inoperative position and is held by disengagement mechanisms 50 on either side of the drawer 24 as drawer 24 and tray 14 of the shredder are moved to an open position. Only one side of the drawer and disengagement mechanism are shown in FIGS. 9-11, though it should be understood that the opposite side is substantially similar in construction, as depicted in FIGS. 12-13, for example. As seen in FIG. 9, as the drawer 24 is moved away from the shredder mechanism 20, the feed mechanism 26 is moved upwardly via angled and upward guidance of axle 34 (connected to pivot arms 30) along wall 27. The pivot arms 30 are pivoted upwardly away from the tray 14 as the axle 34 is guided along the wall(s) 27. The disengagement mechanisms 50 can each rotate about their axis 52 from its retracted position to its extended position. As the axle 34 is guided over a back edge of the drawer, as shown in FIG. 10, it is moved into contact with the disengagement mechanisms 50. FIG. 11 shows the disengagement mechanism 50 in its extended position holding the feed mechanism 26 and thus feed members 36 in an inoperative feeding position. This allows for filling of the tray 14, for example.

The drawer 24 only has to be partially open as to initiate the movement of the axle 34 up along walls 27 of the guide channel on its way to rest on the top surface of the extended, biased retainer 50. The action of opening the drawer 24 allows the retainer 50 to pivot to its extended position (e.g., a vertical orientation).

In addition to guiding movement of the feed mechanism 26 into a third position, the opening 25 and wall 27 in the drawer 24 further provided clearance for when the axle 34 is moved between its lowered and raised positions.

In an embodiment, the shredder 10 includes a safety switch for detecting if the drawer 24 or lid 18 is moved to the open position. The safety switch is coupled to the shredder mechanism 20 and constructed and arranged to prevent operation of the cutter elements when the drawer or lid is in the open position. The shredder may also comprise any number of sensors. In an embodiment, a sensor is provided in tray 14, feed bed 15, and/or drawer 24 for sensing the presence of paper sheets or a stack 22. The sensor may be used to communicate with a controller in the shredder mechanism 20 that sheets are ready to be shredded or destroyed, or to communicate with the feed driver system. The presence of sheets may also start a timer for controlling at least a start time for rotating the feed mechanism 26. A time delay may also be activated such that a feed mechanism 26 begins to move or rotate after a set period of time (e.g., 30 minutes, 1 hour). The sensor may be of any type, e.g., optical, electrical, mechanical, etc. and should not be limiting. Additionally, audio sensors may be used with tray 14, bed 15, or drawer 24. For example, a sensor may be able to pick-up audio signals or sounds when paper is shredding or as paper is lifted. Further, in an embodiment, the pivot arms 30 may be activated and articulated (e.g., up and down or pivotally) when the lid 18 or drawer 24 is closed. When the drawer 24 is opened or the lid 18 is lifted to access the tray 14, the motor may be deactivated via sensor detection, thus the feed mechanism 26 is prevented from movement (e.g., pivotally or up and down, or the rotation of, or both).

As the drawer is moved to its closed position adjacent to the shredder mechanism 20, the paper feed mechanism is released from holding the feed mechanism 26 in the inoperable position. That is, as the drawer is pushed forward, at least the axle 34 is moved along the back edge of the drawer 24 and guided downwardly along the wall 27 of the guide channels into the opening 25. It is thus moved to an operable position for advancing the articles into the cutter elements 21 of the shredder mechanism 20.

The shredder 10 may also comprise a control panel (not shown).

A power switch (not shown) may also be provided on the shredder 10. The power switch may be provided on tray 14, for example, or anywhere else on the shredder 10. The power switch can include a manually engageable portion connected to a switch module (not shown). Movement of the manually engageable portion of switch moves the switch module between states. The switch module is communicated to a controller (not shown) which may include a circuit board. Typically, a power supply (not shown) is connected to the controller by a standard power cord with a plug on its end that plugs into a standard AC outlet. The controller is likewise communicated to the motor of the shredder mechanism 20. When the switch is moved to an on position, the controller can send an electrical signal to the drive of the motor so that it rotates the cutting elements 21 of the shredder mechanism 20 in a shredding direction, thus enabling paper sheets to be fed therein. The switch may also be moved to an off position, which causes the controller to stop operation of the motor. Further, the switch may also have an idle or ready position (which can communicate with an optional control panel, for example). The switch module contains appropriate contacts for signaling the position of the switch's manually engageable portion. Generally, the construction and operation of the switch and controller for controlling the motor are well known and any construction for these may be used. Also, the switch need not have distinct positions corresponding to on/off/idle, and these conditions may be states selected in the controller by the operation of the switch.

The shredder 10 may have any suitable construction or configuration and the illustrated embodiments are not intended to be limiting in any way.

The advancement or feed mechanisms 26 for "automatically" feeding one or more sheets as shown in FIG. 1 or FIG. 2 for use with shredder 10 ideally allow a user to drop off a stack of paper sheets or documents without having the need to manually feed individual or a present quantity of sheets into the shredder 10. For example, a user would add a stack of documents into the curved feed bed 15 of the tray 14 and be able to walk away. The shredder 10 may then either automatically engage in shredding the documents in the tray 14 (e.g., upon closure of the drawer 24, lid 18, or via sensor), or set a preset timer so as to delay the time the shredder 10 is activated for the shredding process to begin. A user may also activate the shredding process by pushing a button(s) on a control panel.

One major advantage of the described advancement mechanisms in shredder 10 is the decreased amount of time a user must spend shredding documents. For example, the productivity of a user would be improved since the user is able to perform other tasks while the shredder 10 is activated. Another advantage is that the shredder 10 is designed to handle paper or documents of different sizes, textures, shapes, and thicknesses, including letter, legal, and A4 size paper, as well as envelopes and stapled sheets, for example. The documents may also be in any order.

Optionally, the shredder 10 may be utilized in a system having a centrally located shredder unit for a multitude of users. For example, the shredder 10 allows for each individual to save what they need to shred at a later time in their own individual tray. An individual can fill his or her own tray until shredding is needed. Each individual may then insert the tray into the drawer 24 of the shredder 10.

As noted above with respect to FIG. 1, the shredder 10 comprises a housing 12 that sits on top of a container 16, which may house a separate and removable waste bin, bag, or collection device, or be a collection device or waste bin itself. However, it should be understood that such a depiction is not intended to be limiting. Further, the housing 12 may be a detachable shredder mechanism that may be removed from the container 16, for example, in an embodiment. In an embodiment, a step or pedal device can be provided on the container to allow a user to access therein (e.g., for emptying shredded particles) and/or to discard waste into the container (or bin housed therein) without being passed through the shredder mechanism 20. In an embodiment, part of the housing may include a door with a hinge to provide access to the inside of the container or bin.

Although a waste bin is described as being provided in the container 16 in the above embodiments, it is optional and may omitted entirely. Generally, container 16 may have any suitable construction or configuration.

Accordingly, this disclosure is directed towards a shredder that includes: a housing; a paper shredder mechanism received in the housing and including a motor and cutter elements, the motor rotating the cutter elements in an interleaving relationship for shredding paper sheets fed therein; a tray for holding a stack of paper sheets to be fed into the cutter elements; a movable feed mechanism positioned above the tray, the movable feed mechanism having at least one feed member with at least one elastic arm, the at least one feed member adjacent to the tray for engaging and disengaging the stack with the at least one elastic arm; and a feed driver system constructed to drive the at least one feed member to rotate in a feeding direction with the at least one elastic arm thereof elastically deforming to apply pressure and frictionally feed paper sheets atop the stack to the cutter elements.

Also provided is a method for advancing articles into cutter elements for shredding. The method includes: providing a tray for holding a stack of articles for feeding into the cutter elements; providing a movable feed mechanism above the tray to advance articles into the cutter elements, the movable feed mechanism having at least one feed member with at least one elastic arm, the at least one feed member adjacent to the tray for engaging and disengaging the stack with the at least one elastic arm; rotating cutter elements in an interleaving relationship for shredding articles fed therein; and driving the movable feed mechanism in a feeding direction to feed articles to the cutter elements from atop the stack of paper sheets in the tray into the rotating cutter elements. The driving of the movable feed mechanism includes rotating the at least one feed member in a feeding direction with the elastic arm thereof elastically deforming to apply pressure and frictionally feed paper sheets atop the stack to the rotating cutter elements.

This disclosure also describes a shredder that includes: a housing; a paper shredder mechanism received in the housing and including a motor and cutter elements, the motor rotating the cutter elements in an interleaving relationship for shredding paper sheets fed therein; a tray for holding a stack of paper sheets to be fed into the cutter elements; a drawer configured for sliding movement between an open position away from the shredder mechanism and a closed position adjacent to the shredder mechanism; a paper feed mechanism positioned above the tray, the paper feed mechanism having at least one feed member with at least one elastic arm adjacent to the tray, the at least one feed member adjacent to the tray for engaging and disengaging the stack with the at least one elastic arm; a feed driver system constructed to drive the at least one feed member to rotate in a feeding direction to feed paper atop the stack to the cutter elements; and a disengagement mechanism provided adjacent to the paper feed mechanism for holding the at least one feed member in an inoperable feeding position when the drawer is in the open position.

Also, this disclosure provides a method for operating a shredder for shredding. The method includes: providing a shredder mechanism with cutter elements positioned on parallel shafts; providing a tray for holding a stack of articles for feeding into the cutter elements; providing a drawer configured for sliding movement between an open position away from the shredder mechanism and a closed position adjacent to the shredder mechanism; providing a paper feed mechanism above the tray to advance articles into the cutter elements, the paper feed mechanism having at least one feed member with at least one elastic arm adjacent to the tray, the at least one feed member positioned adjacent to the tray for engaging and disengaging the stack with the at least one elastic arm; providing a disengagement mechanism adjacent to the paper feed mechanism for holding the paper feed mechanism in an inoperable feeding position when the drawer is in the open position; rotating cutter elements in an interleaving relationship on the parallel shafts for shredding articles fed therein; driving the paper feed mechanism to rotate in a feeding direction to feed articles to the cutter elements from atop the stack of articles in the tray into the rotating cutter elements; moving the drawer into its open position away from the shredder mechanism; and holding the paper feed mechanism in an inoperable feeding position using the disengagement mechanism.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a housing;

a shredder mechanism received in the housing and including a motor and cutter elements, the motor rotating the cutter elements in an interleaving relationship for shredding articles fed therein;

a tray for holding a stack of articles to be fed into the cutter elements;

a movable feed mechanism positioned above the tray, the movable feed mechanism comprising at least one rotatable feed member with at least one elastic arm extending therefrom, the at least one rotatable feed member positioned adjacent to the tray for engaging and disengaging the at least one elastic arm with the stack; and a feed driver system constructed to drive the at least one feed member to rotate in a feeding direction with the at least one elastic arm thereof rotating with the at least one feed member and elastically deforming during its rotation to apply pressure to feed articles atop the stack to the cutter elements.

2. The shredder according to claim 1, wherein the at least one elastic arm comprises a protruding tip, wherein the protruding tip is configured for insertion into the stack of articles as the at least one elastic arm applies pressure to the articles atop the stack during rotation of the at least one feed member.

3. The shredder according to claim 2, wherein the movable feed mechanism further comprises a pivot arm for moving the feed member between a lowered position for engaging the stack to feed articles and a raised position for disengaging from the stack during rotation of the at least one feed member, and wherein the protruding tip of the at least one elastic arm is configured exert greater pressure on the stack via driving the protruding point into the stack of articles and against an opposing surface of the tray as the pivot arm is moved between the lowered position and the raised position.

4. The shredder according to claim 3, wherein the driver system comprises a driver for moving the pivot arm between the lowered and raised positions and a rotary driver mounted to the at least one feed member for rotation.

5. The shredder according to claim 1, wherein the movable feed mechanism comprises two feed members adjacent to the tray, each feed member having one elastic arm, the two feed members mounted on an axle and the feed driver system comprising a driver for rotating the axle to drive the two feed members to rotate in the feeding direction with their elastic arms elastically deforming to apply pressure to feed articles atop the stack to the cutter elements.

6. The shredder according to claim 5, wherein each elastic arm comprises a protruding tip for insertion into the stack of articles as the feed members rotate in the feeding direction.

7. The shredder according to claim 1, wherein the movement of the movable feed mechanism is activated using a device selected from the group consisting of an optical sensor, electromechanical sensor, and switch.

8. The shredder according to claim 1, wherein the tray includes a curved feed bed curved upwardly and forwardly towards the shredder mechanism to assist in feeding articles in a forward and upward direction into the shredder mechanism.

9. The shredder according to claim 8, wherein the at least one feed member is configured to compress during rotation about its axis in the feeding direction as it contacts the curved feed bed to feed articles into the shredder mechanism.

10. The shredder according to claim 1, further comprising a drawer configured for sliding movement relative to the shredder mechanism between an open position away from the shredder mechanism and a closed position adjacent to the shredder mechanism, and wherein the tray is provided within the drawer and configured for movement therewith.

11. The shredder according to claim 10, further comprising a disengagement mechanism provided adjacent to the movable feed mechanism for holding the at least one feed member in an inoperable feeding position away from the tray when the drawer is in the open position.

12. The shredder according to claim 11, wherein the drawer comprises a guide channel for directing movement of the at least one feed member into the inoperable feeding position during movement of the drawer from the closed position to the open position.

13. The shredder according to claim 11, wherein the disengagement mechanism is configured for movement between a retracted position and an extended position, wherein the disengagement mechanism is in an extended position when the drawer is in the open position, and wherein the disengagement mechanism is configured to hold the at least one feed member in the inoperable feeding position away from the tray when the drawer is moved into the open position.

14. The shredder according to claim 10, further comprising a safety switch for detecting if the drawer is moved to the open position, the safety switch being coupled to the shredder mechanism and constructed and arranged to prevent operation of the cutter elements when the drawer is in the open position.

15. The shredder according to claim 1, wherein the shredder further comprises a deflector device with a deflecting surface provided above the shredder mechanism that is configured to deflect and direct articles fed by the at least one feed member into the shredder mechanism.

16. The shredder according to claim 1, wherein the shredder further comprises a waste bin for receiving articles from the cutter elements.

17. The shredder according to claim 1, wherein the movable feed mechanism is further positioned adjacent to the shredder mechanism.

18. A method for advancing articles into cutter elements for shredding comprising:

providing a tray for holding a stack of articles for feeding into the cutter elements;

providing a movable feed mechanism above the tray to advance articles into the cutter elements, the movable feed mechanism comprising at least one rotatable feed member with at least one elastic arm extending therefrom, the at least one rotatable feed member positioned adjacent to the tray for engaging and disengaging the at least one elastic arm with the stack;

providing a shredder mechanism with cutter elements positioned on parallel shafts;

rotating cutter elements in an interleaving relationship on the parallel shafts for shredding articles fed therein; and driving the movable feed mechanism in a feeding direction to feed articles to the cutter elements from atop the stack of articles in the tray into the rotating cutter elements, wherein the driving comprises rotating the at least one rotatable feed member in a feeding direction with the elastic arm thereof rotating with the at least one feed member and elastically deforming during its rotation to apply pressure to feed articles atop the stack to the rotating cutter elements.

19. The method according to claim 18, wherein the at least one elastic arm comprises a protruding tip, and wherein the method further comprises inserting the protruding tip into the stack of articles as the at least one elastic arm applies pressure to the articles atop the stack during rotation of the at least one feed member.

20. The method according to claim 19, wherein the movable feed mechanism further comprises a pivot arm for moving the feed member between a lowered position for engaging the stack to feed articles and a raised position for disengaging from the stack during rotation of the at least one feed member, and wherein the method further comprises: driving the movable feed mechanism between the lowered position for engaging the stack and the raised position for disengaging the stack during the rotation of the at least one feed member, wherein the protruding tip of the at least one elastic arm exerts greater pressure on the stack of articles via driving the protruding point into the stack of articles and against an opposing surface of the tray as the pivot arm is driven between the lowered position and the raised position.

21. The method according to claim 18, wherein the movable feed mechanism comprises two feed members adjacent to the tray, each feed member having one elastic arm, the two feed members mounted on an axle and the feed driver system comprising a driver for rotating the axle, and wherein the method comprises: rotating the two feed members in the feeding direction with their elastic arms elastically deforming to apply pressure to feed articles atop the stack to the cutter elements.

22. The method according to claim 18, wherein the tray includes a curved feed bed curved upwardly and forwardly towards the shredder mechanism to assist in feeding articles in a forward and upward direction into the shredder mechanism, and wherein the rotating of the at least one feed member further comprises: compressing the at least one feed member during rotation about its axis in the feeding direction as it contacts the curved feed bed to feed articles into the shredder mechanism.

23. The method according to claim 18, further comprising providing a drawer configured for sliding movement relative to the shredder mechanism between an open position away from the shredder mechanism and a closed position adjacent to the shredder mechanism, wherein the tray is provided within the drawer and configured for movement therewith, and wherein the method further comprises: detecting if the drawer is in the open position, and stopping or preventing operation of the cutter elements if the drawer is in the open position.

24. The method according to claim 23, further comprising using a disengagement mechanism provided adjacent to the movable feed mechanism to hold the at least one feed member in an inoperable feeding position away from the tray when the drawer is in the open position.

25. The method according to claim 18, further comprising deflecting and directing articles fed by the at least one feed member into the shredder mechanism using a deflector device with a deflecting surface provided above the shredder mechanism.

26. The method according to claim 18, further comprising activating the driving of the movable feed mechanism using a device selected from the group consisting of an optical sensor, electromechanical sensor, and switch.

* * * * *